US005806424A

United States Patent [19]

Elliot

[11] Patent Number: 5,806,424

[45] Date of Patent: Sep. 15, 1998

[54] APPARATUS AND METHOD FOR REGISTERING SILK SCREENS

[76] Inventor: Daniel J. Elliot, 23309 Dolorosa St., Woodland Hills, Calif. 01367

[21] Appl. No.: 547,442

[22] Filed: Oct. 24, 1995

Related U.S. Application Data

[63] Continuation-in-part of Ser. No. 141,397, Oct. 22, 1993, abandoned.

[51] Int. Cl.[6] ..... B41F 15/10

[52] U.S. Cl. ..... 101/127.1; 101/115; 101/126; 101/127; 101/128.21; 101/DIG. 36; 33/620

[58] Field of Search ..... 101/114, 115, 101/126, 127, 127.1, 128, 128.21, 128.1, 129, 481, 485, 486, DIG. 36; 33/614, 617, 619–621

[56] References Cited

U.S. PATENT DOCUMENTS

| | | | |
|---|---|---|---|
| 4,223,055 | 9/1980 | Castelluzzo et al. | 428/40 |
| 4,463,673 | 8/1984 | Moore | 101/126 |
| 5,052,291 | 10/1991 | Takahashi et al. | 101/129 |
| 5,129,155 | 7/1992 | Hoffman et al. | 101/DIG. 36 |
| 5,136,948 | 8/1992 | Fujino et al. | 33/621 |
| 5,241,187 | 8/1993 | Ikeda et al. | 101/114 |

FOREIGN PATENT DOCUMENTS

| | | | |
|---|---|---|---|
| 49218 | 3/1986 | Japan | 101/486 |
| 86579 | 4/1991 | Japan | 101/DIG. 36 |

OTHER PUBLICATIONS

"Preregistration", Susan Venell, Jul. 1983, pp. 92–95.

*Primary Examiner*—Stephen R. Funk
*Attorney, Agent, or Firm*—Marvin H. Kleinb; Arant, Kleinberg, Lerner & Ram, LL

[57] ABSTRACT

Printing screens are registered using a photosensitive position locating sensor which is affixed to a pallet and aligned with the image of a register mark on the first of a series of printing screens. The location of the image is stored and signalled in a display device. The pallet is then roughly aligned with a second and subsequent screens of the series. The subsequent screens are each moved until the display image of its register mark is superimposed upon the stored image. The signal output from the sensor is applied to a microprocessor which controls the display device.

20 Claims, 15 Drawing Sheets

PRIOR ART

APPARATUS AND METHOD FOR REGISTERING SILK SCREENS

This is a continuation-in-part of application Ser. No. 08/141,397, filed Oct. 22, 1993, now abandoned.

FIELD OF THE INVENTION

This invention relates generally to silk screen printing, and more particularly to an improved apparatus and method for registering silk screens.

BACKGROUND OF THE INVENTION

Screen printing, also known as silk screen printing or serigraph printing, is a well known print-making process. Screen printing has been used to create prints on many surfaces, such as glass, wood, plastic, paper, cardboard & cloth. A wide variety of inks may be used, including resin-based inks as well as water-based inks, and even metallic inks which can conduct electricity.

In its simplest method, a one color graphic design, illustration or the like is photographically transferred to a piece of film called a film positive 59, as shown in FIG. 5 the image being black, the rest of the film being clear. Next, a porous mesh of fine silk, Nylon, DACRON® polyester fiber or stainless steel (all generally referred to as silk screen material in the art) is stretched and mounted on a frame. This is now a "silk screen" 11 (FIGS. 1*a* & 5). (Typically, a silk screen used on automated machines of the type described herein, measures approximately 24"×30".) The entire silk screen is coated with a light-sensitive, photochemical translucent emulsion , and is now ready to be processed.

The film positive is then temporarily bonded to the screen, and with the aid of a screen developing machine, photochemically developed, or more colloquially "burned-in", onto the screen 11*c* (FIGS. 1*a* & 5). Thus, the image portion of the film positive will burn through the emulsion, leaving that portion of the screen mesh open and porous, while the non-image areas of the film positive will have no effect on the emulsion, thus leaving it on the screen.

After the film positive is removed, the screen may then be placed directly onto the surface to be printed, which may be, eg., a shirt or a piece of paper. Ink of the desired color is put on the screen at one end, and with the aid of an elongated hard piece of rubber or the like, called a "squeegee", the ink is drawn across the screen and forced through the open, or burned-in, portions of the fine screen mesh onto the material to be printed, thus transferring the graphic image to the material. (Ink will be blocked from passing through the non-image portions of the screen by the emulsion remaining on the screen.)

With artwork composed of two or more colors, it is necessary to break down the original artwork into its component colors before the printing screens can be processed. By photographic and other graphic arts techniques, the design is "separated", so that one film positive is produced for each color contained in the design. Thus all the elements in the design that are blue, for example, will appear on one film positive; all the elements that are red, will be on another film positive, and so on. After the design is separated, each film positive is placed in the essentially same position on its own separate silkscreen, developed as described above, resulting in one processed screen for each color contained in the design. The screens are now ready to be utilized for printing the design, i.e., one screen for the "red" portion of the composite print graphic, and one screen for the "blue" portion of the composite print graphic, and so on.

Silk screen printing is performed either by hand, in small scale printing shops or by artists, or by machines, both manual and automated, in larger commercial printing facilities. Although there are technical differences, essentially the process is the same in each case, i.e., the material to be printed rests on a flat surface, the material and the screen are brought together, and ink is forced through the image portions of the screen mesh onto the surface to be printed.

Most commercial silk screen printing is performed by automated and semi-automated screen printing machines, which are used to print on cloth, paper, plastic and other products. It is to these machines that the apparatus and method contained in this application is primarily directed. These machines normally may have the capacity to utilize from 5–12 screens and turn out 300–600 composite prints an hour.

Often times the machines are rotary or oval shaped, and are comprised of fixed multiple stations. FIG. 14*a* illustrates a typical multi-station screen printing press. There is typically a loading station 60, where the material to be printed is first placed, an unloading station 61, where the printed material is removed, and a plurality of printing stations 62. At each printing station 62 as shown in FIG. 14*b*, there are means for holding 63 and locking 64 a screen, a means 65 for holding a squeegee for that screen, controls 66 for adjusting the screen on the X, Y, and on the rotary axes, and a squeegee 67 for that screen.

Further, there is a group or set of means 68 for holding the materials to be printed upon. These material, or work piece holding means 68 are positioned one at each printing station 62, and underneath the screen holding stations. The set of material holding means 68 advance or index around the stations 62, so that each of the material holding means 68 in turn arrives at the loading station 60 where it will receive or have the material loaded onto it. It will then sequentially advance to positions at the printing stations 62, stopping at each station 62 beneath a screen and then moved in close proximity to said screen, which contains ink of a desired color, where that color portion of the image is printed, or "squeegeed" onto the material. It finally reaches the unloading station 61 where the fully printed material is removed. The sequential advancing of the material holding means is normally mechanized, and automatic at predetermined time intervals.

The holding means 68, called platens, or more colloquially "pallets", are commonly hard, flat, generally rectangular shaped pieces of metal, wood, or the like. Each pallet is mounted to the machine, and serves as the surface upon which the material to be printed rests.

In typical operation, each screen is mounted in a frame at a station with an associated squeegee 67, and the appropriate colored ink placed at one end of the screen. (It should be remembered that each screen represents that portion of the composite print graphic that is the same color, i.e., one color per screen.) If, for example, one T-shirt were to be printed with a multi-colored print, it would first be loaded onto a pallet at the loading station 60, the first station just before the screen printing stations, said loading station not having holding means for a screen. (Normally, an adhesive is sprayed on the pallet first to ensure that the T-shirt will not move on the pallet as it is printed and moves around the machine.) The pallet with the T-shirt on it advances to a fixed position under the first screen station and is mechanically (automatically) brought into close proximity (approximately 1/16") to the screen. Ink is then squeegeed across the screen (the pressure causing the screen to touch the pallet) and forced through the open portion of the screen mesh onto the T-shirt, thus transferring that portion of the composite print graphic of the same color contained on that screen, to the T-shirt.

The pallet and the screen are then automatically separated and the pallet (with the T-shirt affixed) moves to the next screen station, where, once again, the pallet and screen are brought into close proximity and ink is squeegeed onto the T-shirt, thus adding a second portion, or color, of the composite print graphic to the T-shirt. This process is repeated until all the composite portions of the print graphic, i.e., all the colors contained in the design, have been printed on the T-shirt, each screen having sequentially printed its portion of the design. The fully printed T-shirt continues its course around the machine until it reaches the final station, the unloading station 61 (like the loading station, without means for holding a screen), where it is removed and put through a dryer for "fixing" the ink, thus making it permanent on the T-shirt.

In actual practice, T-shirts (or whatever material is to be printed) are loaded on each pallet as they pass the loading station, so that after the first full cycle, all the pallets, as they are moving around the machine, have T-shirts on them, each at a different sequential stage of completion. For example, the T-shirt at the second screen station will have been printed with two portions of the composite print graphic, or two colors, and ready for the third as it advances to the third station, while at the same time the T-shirt at the sixth station will have been printed with six portions of the composite print graphic, or six colors. The T-shirts will continue around the machine to be sequentially printed with as many colors as are contained in the design, and then, when fully printed, unloaded as described above.

It can be seen that in designs comprising two or more colors, and therefore requiring two or more screens, it is necessary to preposition, or align the screens before printing, so that, when each screen sequentially prints its portion of the composite print graphic, the images are in the approximate exact positions to accurately reproduce and reflect the original artwork. This process of prepositioning, or aligning multiple screens is called "registering", and before any production run utilizing multiple screens can begin, all the screens must be "registered", to ensure the proper fit of colors. Some designs may require colors to be separated by a required distance, while others may require colors to be aligned edge to edge with no separations. If good registration is not accomplished, colors may overlap and "bleed" into one another, or alternatively, be separated when they should be touching. Prints that are "out of register" may be blurry, inaccurate and generally inconsistent with the original artwork, and so, it can be seen that good registration is essential to the print making process.

Numerous methods and systems for prepositioning, or registering silk screens on a printing apparatus have been known and practiced throughout the history of the art.

In the most basic method, used primarily in hand printing, boundary lines or register marks are placed on a printing table surface. Tape, cardboard, or even nails hammered into the table may be used to define the physical boundaries and contours. The material to be printed, and/or the screens, are then "lined up" according to the boundaries. This method may provide the most basic of registration needs, but is not accurate or fast enough to provide proper registration of all the screens that are used in a typical multi-colored print.

The most common method used to register silk screens is to cause each film positive in a given design, to be affixed with register marks, so that the register marks are located in the essentially same position on each film positive. In most cases this is accomplished by affixing two or more standard register marks, usually on opposite sides of the design, to the original artwork prior to separating the design into its component colors, or print portions. As the artwork is photographically separated, the register marks are transferred to each film positive along with its portion of the composite print graphic in the same relative position, resulting in each film positive being registered to the others. These register marks are often small circles containing intersecting cross hairs forming an X, Y axis 11*d* (FIG. 1*a*). (Two spaced apart register marks are used to ensure that movement of the screens in the rotary axis' are accommodated in addition to the X & Y axis' when registering said screens.) This type of register mark shall be referred to as a "standard" register mark throughout this disclosure, to distinguish it from the "new" register marks, which are an essential element of the apparatus and method disclosed herein.

The film positives containing the standard register marks and the images to be printed, are then developed, or burned-in onto the screens. After the screens are mounted on the machine, a sample print is made, such that the register marks on the first screen will appear on the surface of the sample. When the surface is moved to a subsequent station and moved into close proximity to the next screen, the register marks on said screen at that station are manually aligned with the register marks on the printed sample, either visually, by pressing the register marks on the screen down to touch the register marks on the printed sample, or by superimposing one set of printed register marks on the other. This process is repeated for each screen. In this manner, each of the subsequent screens can be adjusted and fixed in position so as to be in alignment with the register marks from the initial screen, printed on the test surface. (Once all the screens are registered, or prepositioned, the register marks are typically covered with tape prior to the production run, so as to allow only the composite portions of the graphic design to be printed, i.e., to prevent the register marks from appearing on the material to be printed.)

As can be seen, this approach has numerous problems. Since it relies heavily on direct visual alignment and since the burned-in register marks on the screens are usually very small and difficult to keep clean and see through, proper alignment may require the investment of a substantial period of time, and be inaccurate. So, in practice, many times the register marks are not used.

Instead, alignment is typically achieved by printing the image contained on one screen on a test surface, and then pressing subsequent screens down on the sample printed from the first screen (the printed image can be viewed through the translucent emulsion), and manually adjusting the positions of the subsequent screens until the print elements on the other screens are in proper visual alignment in relation to what has already been printed on the sample from the first screen. When each individual screen is aligned to the printed image, it is fixed in position, until all screens are aligned to the first. This approach, while somewhat easier then the first, is still time consuming, and is also often times inaccurate, requiring numerous screen adjustments, and numerous print samples, until it is correct.

In recent years at least two electronic registration devices have been brought to market to improve upon the standard methods of registration. To the best of applicant's knowledge, both are completely automated, i.e., after preparing the screens with reference marker(s) of some type to react to, or utilize their specific technology, the screens are put on the machines and are moved automatically into their proper preposition. While these systems are extremely fast, they have serious shortcomings. Since they have been developed by screen printing machine manufacturers to accommodate their own specific machines, they are not readily adaptable to the numerous other machines already in use in the industry, each with their own specific configurations of construction and operation and thus, to utilize these systems, one must also buy the costly machines they were designed to work with. Also, said registration devices are extremely expensive, and because they are automated, they may not be able to compensate for variations that occur in screens after continued use due to stretching, relaxation, warping, etc.

In the apparatus and method of the invention described herein, these problems are solved. Accurate registration is provided in a straightforward, extremely quick manner, while being relatively inexpensive, and readily adaptable to virtually all types and brands of printing machines already in use, from multi-station automatic and semi-automatic machines to manual machines to single station machines which may utilize multiple, successive screens to produce graphic art works, printed circuit boards and the like. Additionally, because registration is based on visual alignment on a display and not achieved automatically, discrepancies in problematic screens can be readily seen, accommodated and "averaged" by the user to provide adequate registration in most cases, saving time and effort. This will be explained in greater detail later.

SUMMARY OF THE DISCLOSURE

The illustrated apparatus comprises a pair of photo-optical sensors, one for each register mark. The sensors are electrically connected to a controller, which, in turn, is electrically connected to a visual display.

The sensors are responsive to a spot of light as it engages and moves across the sensor's surface, so as to send signals indicating the relative position of the light spot to the sensor. The light spot is created by affixing specially configured register marks to the printing screens, said register marks allowing a spot of light to pass through, and called "new" register marks. In this way the sensors can determine the location of each light spot, i.e., each new register mark, in relation to its position on each sensor.

The controller receives the positional signals sent by the sensors, processes the data, calculates the location of the light spots on the sensors and transmits the information to the visual display.

The visual display responds to the signals sent by the controller and by means of indicators, e.g., LED's arranged in a matrix, accurately represents the position of the new register marks, i.e. the light spots, and by extension the screen with the new register marks affixed thereto, on the sensors. In this manner, a visual representation of the orientation of a printing screen in relation to its position on the sensors is determined.

In practice, the sensors, which may either be permanently fixed in or on the pallet in a predetermined position, moved and affixed manually to the pallet, as per the requirements of each design, or built into a pallet and moved by a mechanical motion system, are selectively positioned, and brought into contact with, the new register marks on the first, base screen, said position being reflected on the display by means of lit indicators. (The first, base screen is that screen to which all subsequent screens will be aligned, or registered.) A circuit on the apparatus is then actuated, causing said lit indicators to be fixed on the display, as first indicia, and continuously displayed throughout the registration process. The pallet with the sensors, which have been locked in place, is moved underneath, and brought into contact with, the new register marks on the second screen, causing a second set of lit indicators or second indicia to appear on the display, reflecting the position of the new register marks of the second screen in relation to the sensors. Said second screen is registered to the first, base screen by moving the screen until the display indicates that the light spots passing through the new register marks on said second screen and onto the sensors, are in the same position as those from the first screen, as indicated by said second set of lit indicators moving on the display until they are superimposed on the first set of fixed lit indicators from the first, base screen. When the second set of indicators are matched to the first set of fixed indicators, the second screen is locked in place, and is now registered to the first.

The pallet with the fixed and positioned sensors is then sequentially moved under the new register marks of each subsequent screen, and each said subsequent screen is registered to the first, base screen in the same manner as the second screen, until all the screens are registered to the first, base screen.

DETAILED DESCRIPTION OF THE DISCLOSURE

Throughout this description, the embodiments and examples shown should be considered as exemplars, rather than limitations on, the apparatus and method of the present invention.

Figure 1A:
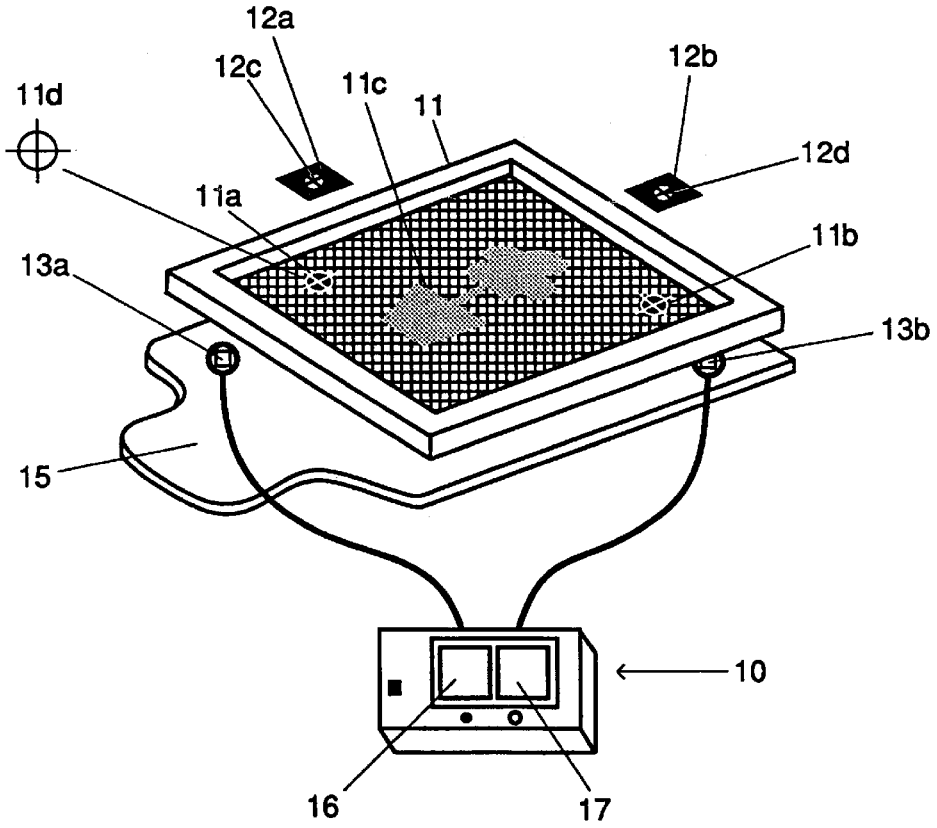
FIG. 1*a* is a perspective view of the apparatus of the present invention for registering printing screens, with a pallet and a screen.
Figure 2:
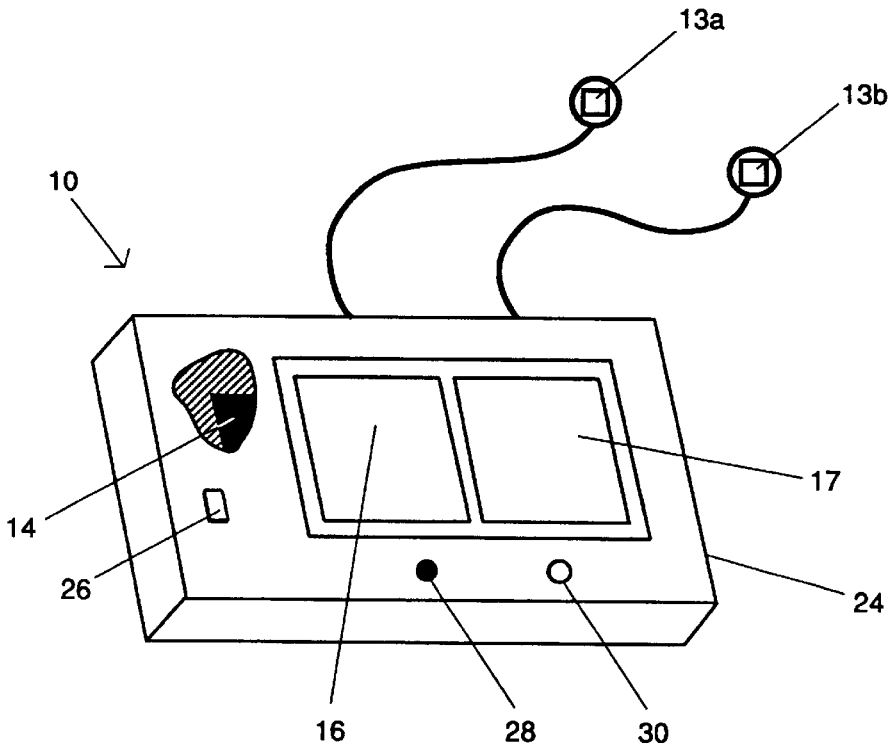
FIG. 2 is a perspective view of the prepositioning apparatus of the present invention.

FIGS. 1*a* and 2 show one embodiment of the registration apparatus 10 of the present invention for registering printing screens. This embodiment is an analog system. (Later a digital system will be described). As can be seen in FIG. 1*a*, a silk screen 11 has previously been developed with standard register marks 11*a*, 11*b* and the image to be printed 11*c*. (11*d* shows a typical standard register mark, in approximate actual size.) In a typical operation where color printing is done, the same register marks are also formed on each of the subsequent screens, in the essentially same position on each screen, along with their respective images to be printed, each a portion of the composite print graphic.

The apparatus 10 of the present invention comprises two generally flat photo-optical sensors 13*a*, 13*b*, an example of which may be the photodetector, Model PIN-SC/10D manufactured by United Detector Technology of Hawthorne, Calif. Sensors 13*a*, 13*b* are well known in the art, are approximately ½" in diameter (1" with the circular housing), and are able to optically determine the location of the centroid or effective center of a spot of light impinging on the sensor's surface as it is moved relative to the sensors, i.e., the sensors have the ability to send signals corresponding to the X & Y position of the light spot relative to its position on the sensor.

The light spots are formed by creating specially configured register marks, i.e., "new" register marks, for each printing screen, such new register marks comprising opaque masks 12*a*, 12*b*, each with a generally circular opening in the center thereof through which light can pass. Once affixed to the printing screens (FIG. 1*c*), light may pass through the new register marks 12*e*, 12*f*, and onto the sensors in the form of light spots, which engage the sensors that have been positioned underneath each new register mark. Creation and placement of new register marks 12*e*, 12*f* (FIGS. 1*b*, 1*c*) will be described in greater detail later. Movement of the light spot is intended to include any movement of said light spot in a horizontal plane generally parallel to the generally flat upper surface of the sensors 13*a*, 13*b*. In this manner, the position of each light spot on each sensor, and by extension the position of the screen, can be analyzed by such sensor, and its location determined.

The apparatus 10 also includes a controller 14 (FIG. 2) which is electrically connected to sensors 13*a*, 13*b*. Controller 14 may include a microcontroller, also known as a microprocessor, such as a Model 68 HC11 made by Motorola, as is well known in the art. The controller 14 may also include memory (RAM), and an E PROM chip which may contain the software for the microcontroller and which may be written in Assembly Language,"C" or other software languages. The controller has the ability to read the output of sensors 13*a*, 13*b*, i.e., to receive the positional signals from the sensors, process the data, and make calculations based on the position of the centroid of each defined spot of light as it moves across each sensor, and thus to locate the X & Y position of each light spot in relation to each sensor. The controller 14 then, in turn, sends signals to the display, "instructing" said display to accurately represent said position by means of actuated, or lit, indicators. Additionally, the controller has the ability to store and "remember" the X & Y coordinates of the locations of each light spot in relation to each sensor.

Controller 14 may be contained in housing 24 with the displays 16 and 17 being mounted on an upper surface. The illustrated apparatus 10 also includes an on/off button or switch 26 which is electrically coupled to, and activates the controller 14, sensors 13*a*, 13*b* and displays 16 and 17, and an "accuracy" control, 30, which enables the user to vary the degree of accuracy or resolution of the apparatus, as per the requirements of each design, by signalling the controller to make the sensitive area of each sensor "smaller" while driving the same display, thus increasing the resolution or accuracy.

The apparatus 10 further includes what may be called a "hold" button 28. The hold button 28 is electrically coupled to the controller 14 which in turn is coupled to the display. The hold button 28, when actuated, causes particular lit indicators or LEDs to be fixed, i.e., to remain in the "on" or lit position, by signalling the controller to store in memory the numbers representing the coordinates of the centroid of the light spot on the sensors. For example, when the user is satisfied with the position of the sensor 13*a* in relation to the spot of light on the first, base screen, that LED e.g., in display 20*a* (FIG. 3) which is on at that moment will be fixed, and remain on throughout the registration process, if hold button 28 is activated. Likewise, an LED in display 20*b* will remain on indicating the position of a spot of light on sensor 13*b*. Again, these two fixed LEDs 21*a* serve as first indicia in the registration process, and subsequent lit LEDs 21*b* created by the position of subsequent screens on the sensors, are moved on the display until they are matched and superimposed on these fixed, lit LEDs created by the position of the first, base screen on the sensors, thus achieving registration. This occurs when the sensed coordinates equal the stored coordinates.

Connected to the controller 14 are a pair of two dimensional graphic displays 16, 17 which indicate and visually exhibit the results of the calculations made by the controller 14 in such a manner that as the light spots move across sensors 13*a*, 13*b*, such movement is visually represented on the associated displays 16 and 17, by means of said actuated indicators. It should be appreciated that the indicators, e.g., LEDs (light emitting diodes) on the associated display, can represent any movement of the new register mark(s) on the sensor(s), i.e., the spots of light, as they move across the generally flat upper surface of the sensors, said LEDs turning on and off as they reflect said movement. It should also be appreciated that, except where otherwise noted, or described, reference throughout this disclosure to the "display" shall mean the entire display comprised of two actual displays, one for each sensor.

Figure 3:
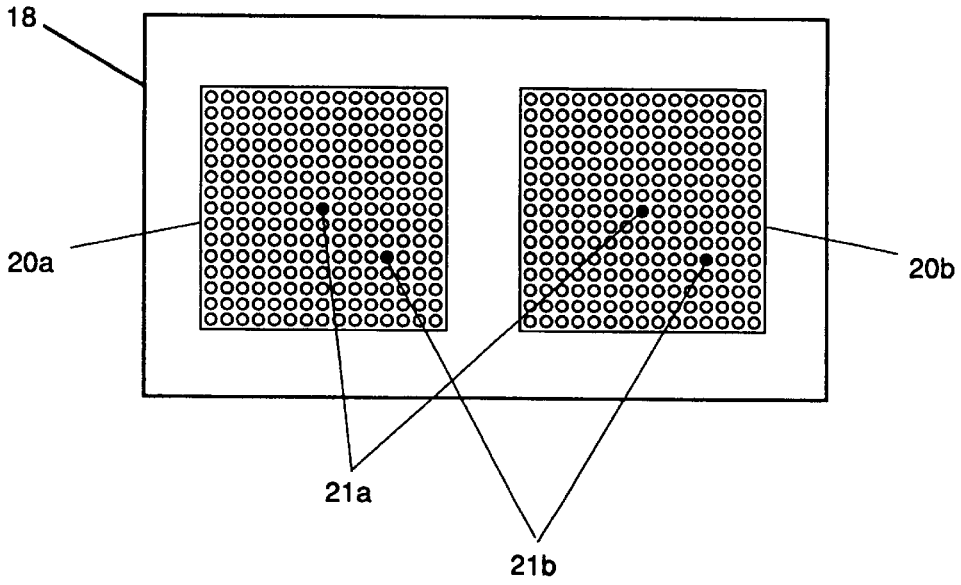
FIG. 3 is an overhead view of a matrix LED display of the present invention.

In the preferred embodiment of the present invention, as shown in FIG. 3, a matrix display of LEDs 18 is used. In such embodiment, each matrix LED display may consist of a plurality of LEDs e.g., 225 LED lights, arranged in a 15×15 square, one display 20*a* corresponding to and visually indicating the position of a spot of light on sensor 13*a*, and the other display 20*b* corresponding to the other sensor 13*b*. In this embodiment, each spot of light engages each sensor and one LED is lit per sensor per display 21*a*, indicating the position of the centroid, or effective center of each said light spot in relation to its X & Y position on each said sensor, i.e., where the X & Y coordinates of its position relative to the sensor, intersect. LEDs 21*a* are then fixed and remain on the display throughout the registration process. This will be discussed in greater detail later. (21*b* illustrates lit LEDs produced by the position of a subsequent screen on the sensors, relative to the fixed lit LEDs from the first, base screen 21*a*). Registration is achieved by moving the subsequent screen until the lit LED's 21*b* are superimposed over the fixed lit LED's 21*a*.

Figure 4A:
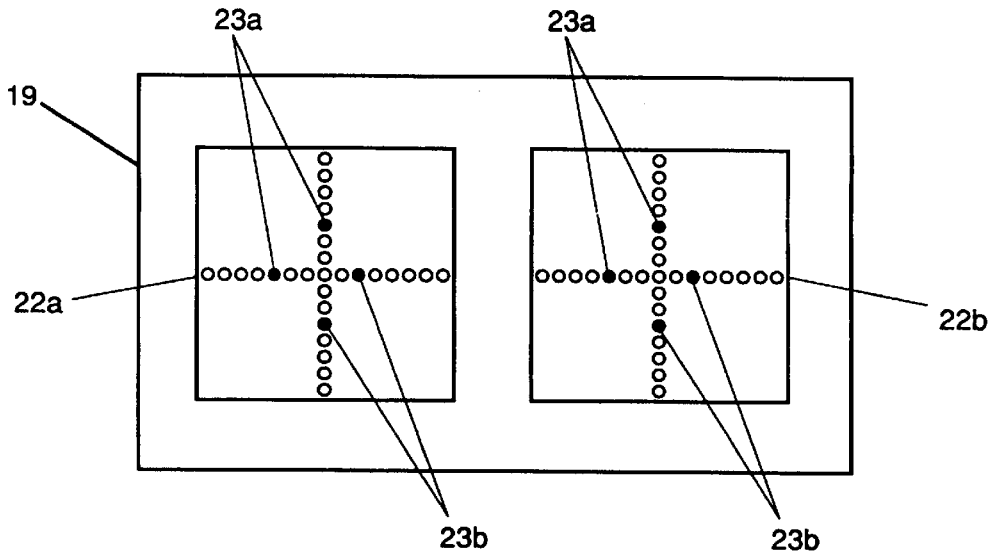
FIG. 4*a* is an overhead view of an alternative display using a cross hair or horizontal and vertical LED display.

In another embodiment, each display may be a horizontal and vertical LED display, as shown in FIG. 4*a*. Here, display 19 consists of first and second perpendicular and intersecting rows of LEDs. Each display 22*a*, 22*b* may comprise intersecting rows of, e.g., ten to twenty LEDs crossing in the center to form a "plus" or "cross hair" representing an X–Y axis. Once again, one display 22*a* is used to indicate the relative position of the light spot to the associated sensor 13*a*, and the other display 22*b* used to indicate the position of the light spot on the other sensor 13*b*. In this embodiment, the spot of light engages the sensor and two LEDs are illuminated per sensor, per display 23*a*, one indicating the location of the X axis and the other indicating the location of the Y axis in relation to the X & Y position of the spot of light on the sensor. (As with the matrix display above, 23*b* indicates the position of a subsequent screen on the sensors, relative to the fixed, lit LEDs from the first, base screen 23*a*.) In either of the above embodiments, other lights or lamps of various types may be used as an alternative to the use of LEDs.

Other types of displays for exhibiting the position of a spot of light relative to a sensor are also within the scope of this invention. For example, instead of using LEDs, either of the two previous display designs may be adapted wherein a programmed LCD (liquid crystal display) is used. In this embodiment, the matrix display 18 or X & Y axis display 19 may be represented in the LCD by small black or colored squares in the same configuration as the LEDs in displays 18 and 19. In such embodiment, the appropriate square or squares would flash, i.e., those squares which correspond to the lit LEDs previously described, reflecting movement of the new register marks on the sensors. When the squares are fixed on the display from the first, base screen, said squares may remain flashing. Registration is noted when flashing squares from subsequent screens are superimposed on the fixed flashing squares.

Figure 4B:
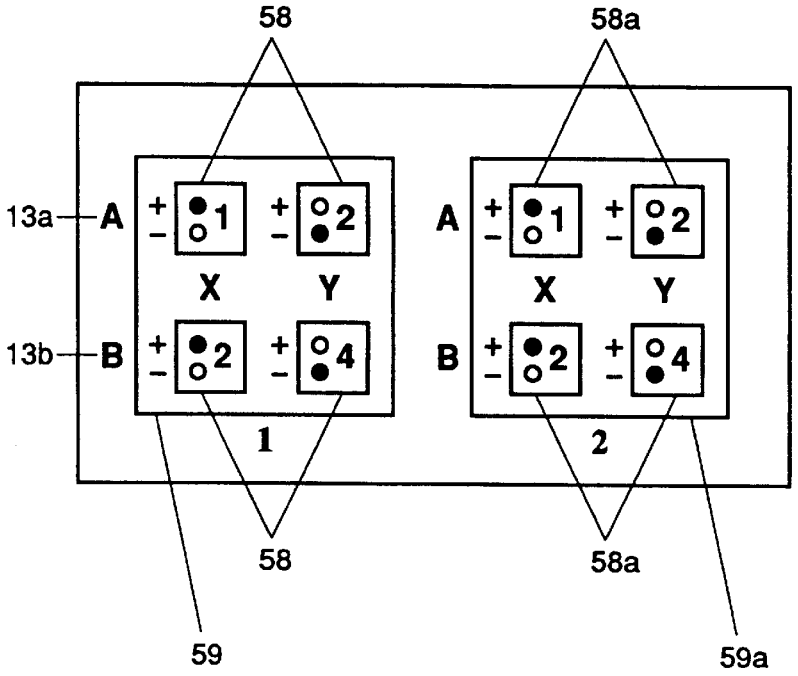
FIG. 4*b* is an overhead view of a numerical display of the apparatus.

Another embodiment may include the use of a digital, or numerical display, FIG. 4*b*, wherein the position of the X & Y coordinates of the centroid of a spot of light on a sensor are numerically determined, interpolated, and displayed by means of LEDs, an LCD, or the like. In this embodiment, the X & Y position of the light spots on the sensors 13*a*, 13*b* (A & B) produce corresponding numerical, and positional coordinates 58 on a first display 59. The numerical coordinates represent the number of units that the centroid of the light spots are displaced from the intersection of X & Y, while the plus and minus indicators show the user whether said numbers are above or below the X axis, or to the left or to the right of the Y axis. Said coordinates are fixed, and subsequent screens are then moved until the same numerical coordinates 58*a* are achieved on a second display 59*a*, resulting from the position of said subsequent screens on the sensors, thus achieving registration.

Yet another embodiment is to use a monitor (e.g., a TV-monitor) which may be programmed with software to display any of the previously described or other designs and patterns and function in the same manner as the other displays (e.g., the monitor may display a matrix of spots or squares as in FIG. 3, display numerical coordinates, or display actual standard register marks).

In the preferred embodiment, the LEDs in display 20*a*, 20*b* (FIG. 3) may be bi-colored, e.g., green and red. In this case, said LEDs may be initially green when on, i.e., as each spot of light passes over sensors 13*a*, 13*b*, different green LEDs 20*a*, 20*b*, would go on and off indicating the movement and position of the spots of light on the sensors. When the position of the sensors and the screen are set and locked on the first, base screen, the hold button 28 is actuated to store the location coordinates of the centroid of the light spots on the sensors, and the particular lit LED representing the position of the spot of light relative to sensor 13*a* on display 20*a*, and the particular lit LED representing the position of the other spot of light relative to sensor 13*b* on display 20*b*, each turn from green to red. These particular now-red LEDs 21*a* are now fixed and will remain lit, as first indicia, throughout the registration process, and, as previously described, other subsequent screens, whose position is represented by a second set of lit LEDs, or second indicia, which are green 21*b*, are moved until said green LEDs are superimposed on the fixed red LEDs from the first, base screen, thus achieving registration.

In another embodiment, the LEDs may be one color, e.g., white. When the hold button is activated, the LEDs from the first, base screen, now fixed, may begin to flash. Registration is noted when lit LEDs from subsequent screens are superimposed on the fixed, flashing LEDs from the first, base screen, with both sets of LEDs then flashing.

Figure 13A:
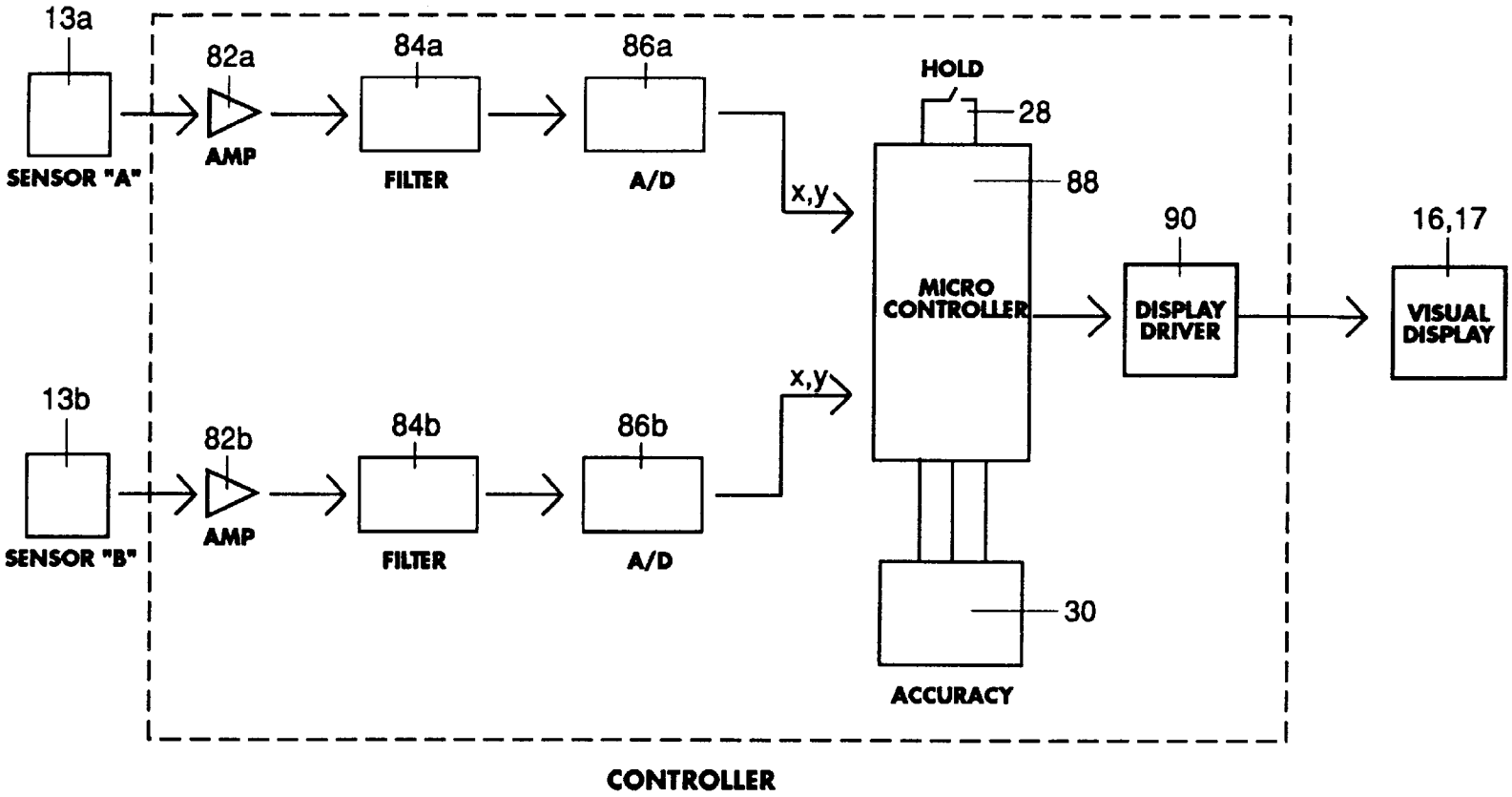
FIG. 13*a* is a block diagram of an analog circuit of the apparatus which converts signals from the sensors to drive a display.

FIG. 13*a* is a block diagram of the apparatus of the present invention in its analog embodiment. As can be seen, in more technical terms, optical sensors 13*a*, 13*b* (A,B) each output X & Y representing signals to the controller. The output of each optical sensor is proportional to the relative location of a light spot on the surface of each sensor in each channel. The output is amplified in amplifiers 82*a*, 82*b* and then filtered in analog filters 84*a*, 84*b* which reduces the effect of variations of light in calculating the exact location of the light spots.

The filtered signals pass through analog to digital circuits (A/D) 86*a*, 86*b* to be converted into a digital format which is usable for the microcontroller 88. (In the Model 68 HC11 made by Motorola, these A/D circuits are integrated within the microcontroller chip itself.) The microcontroller 88 reads the digital signals representing the output of sensors 13*a*, 13*b* and calculates the X & Y locations of each light spot on each sensor 13*a*, 13*b*. This information is, in turn, transmitted to a display driver 90 which controls the visual displays 16, 17 and which signals the location of the light spots on the sensors by means of lit indicators.

Existing printing screens, i.e., screens already made and currently used in production (print shops typically keep thousands of developed screens for designs that are in repeated use), may have traditional standard register marks 11*a*, 11*b* (FIG. 1*a*) already burned into each screen in varying placements (along with their print portion of the composite print graphic), to aid in the registration process. These register marks may not adequately produce the defined spot of light necessary for sensors 13*a*, 13*b* to function properly, and so they may be altered.

In the illustrated apparatus, this potential problem is solved by covering the original standard register marks 11*a*,

11*b* (small circles with cross hairs), already burned-in on each screen, with opaque masks 12*a*, 12*b*, each which may define a generally circular opening in the center thereof. To ensure accurate and easy placement of the masks over the existing burned-in standard register marks, it is first necessary to create said masks in an optimum configuration for that purpose.

Figure 1B:
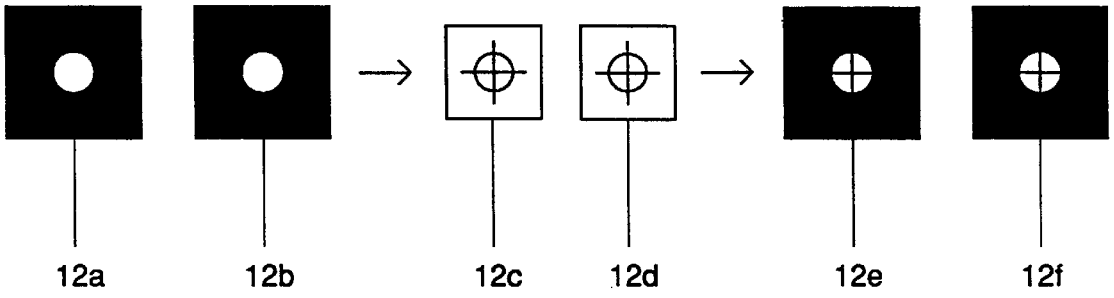
FIG. 1*b* illustrates the creation of "new" register marks using masks for use with the present invention.

FIG. 1*b* illustrates, in what may be approximate actual size, the creation of said masks. First, ¾" to 1" squares may be cut out of opaque black paper or the like. Then holes may be punched close to, or at the center of each said square, creating masks 12*a*, 12*b* (FIG. 1*b*). The openings in the masks (which have no cross hairs) may each be covered with a transparent piece of tape, each having a standard register mark of the same size printed on it 12*c*, 12*d*, said standard register marks on tape centered perfectly over the openings in masks 12*a*, 12*b*, forming new register mark masks 12*e*, 12*f*. Said opaque masks 12*e*, 12*f* which define an opening with transparent standard register marks affixed thereto are placed perfectly over the already burned-in screen register marks 11*a*, 11*b* (FIG. 1*a*) respectively, such that the cross hairs of the register mark 12*c* is aligned with the cross hairs of the register mark 11*a*, and the cross hairs of the register mark 12*d* is aligned with the cross hairs of the register mark 11*b*, thus assuring that the two sets of register marks are "registered" to each other, and thus, when affixed to the screen, creating "new" register marks 12*e*, 12*f* (FIG. 1*c*) in the approximate exact position as the old standard burned-in register marks.

In this manner, an accurate spot of light can be produced such that movement of what are now the new register marks 12*e*, 12*f* and thus of screen 11 can be accurately analyzed and determined by sensors 13*a* and 13*b*, i.e., the new register marks 12*e*, 12*f* (FIG. 1*c*) permit a sufficiently defined light spot to pass through such that proper activation of the sensors 13*a*, 13*b* is achieved. The holes in each mask 12*a*, 12*b* are preferably the same size as the register marks 11*a*, 11*b* pre-existing on the screen, typically approximately 3/16"–¼" in diameter, but may be smaller and still function properly with the apparatus. The masks 12*a*, 12*b* are sufficiently large and opaque around the opening such that they block the passage of ambient light, and the only light hitting the sensors 13*a*, 13*b* is the light which passes through the openings in the new register marks 12*e*, 12*f*.

Preferably, the masks 12*a*, 12*b* (FIG. 1*a*) that have become the new register marks 12*e*, 12*f* (FIG. 1C) are affixed to the screens simply by tape or fixative. Once affixed, the transparent standard register marks on tape 12*c*, 12*d* that have been affixed to the masks 12*a*, 12*b*, may be removed, leaving just the masks with circular openings as the new register marks 12*g*, 12*h* (FIG. 1*d*). (This step is at the discretion of the user, as the apparatus will function properly whether standard register marks on tape 12*c*, 12*d* remain on the masks, or are removed.)

Said affixed masks 12*a*, 12*b* and the openings contained therein 12*e*, 12*f*, or 12*g*, 12*h*, along with the already burned-in standard register marks 11*a*, 11*b*, may then be coated with emulsion on both sides of the screen, making them permanent and thus making the screens easy to clean without the possibility of the masks coming off. (Since the emulsion is translucent, sufficient light will still pass through the holes to permit the sensors to function properly). Also, since these new register marks are now covered permanently with emulsion, ink will not pass through the holes when printing begins, thus avoiding the need to tape over them (as with standard register marks).

As can be seen, the conversion of existing screens from having "standard" register marks to having "new" register marks, is easily, quickly, and permanently accomplished. To further facilitate the conversion of standard register marks to new register marks, and to ensure the accuracy and consistency of the new register mark masks, it is intended that said new register mark masks 12*e*, 12*f* (FIG. 1*b*), be manufactured and mass produced with holes and with standard register marks on tape already perfectly affixed thereto, and made available to users as an accessory. Said masks may also be provided with "peel off" adhesive backs, for ease and efficiency of placement.

New screens may either be prepared in the same manner, i.e., with affixed opaque masks over burned-in standard register marks, as described above, or new register marks may be developed directly onto new screens, avoiding the need for masks, by modifying or adjusting the circuitry of the apparatus and/or adding filters and the like to the sensors of the device, giving it the ability to detect and assess differences in the intensity and quality of light passing through the screen.

In this alternative method of creating new register marks, a registered stencil system may be used to mark film positives with two opaque spots which may be generally circular in shape, and which are, in turn, photochemically developed directly onto the screens, along with the image to be printed on the film positive. Each screen will, after this process, contain two spots which are burned-in, i.e., "clear" and which are the new register marks. Throughout the registration process, the position of these spots may be analyzed by the sensors and displayed on the display by distinguishing between the "pure" light passing through the new register marks (the burned-in spots equivalent to the spots created by the masks, used on existing screens), and the altered light passing through the translucent emulsion surrounding the spots.

The need for masks may also be avoided, on new screens, by utilizing the above mentioned stencil system with opaque emulsion, either on the entire screen, or on the area substantially surrounding the new register marks.

Figure 5:
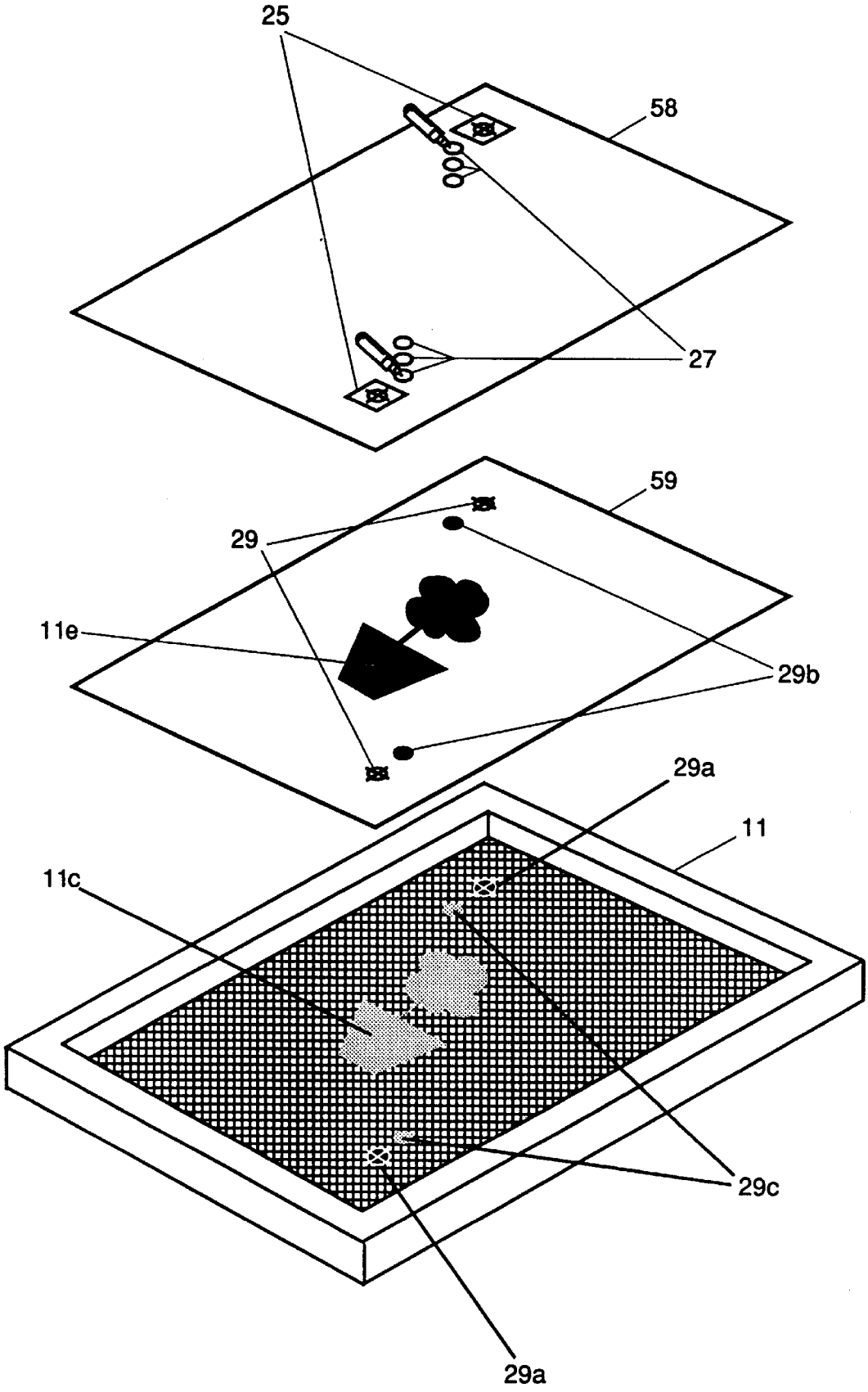
FIG. 5 illustrates a stencil system, for marking film positives and creating new register marks without masks.

A more detailed description of the stencil system follows. A stencil 58 (FIG. 5), made of a piece of thin, clear plastic, or the like, is placed on the first film positive 59, such that the image 11*e* on the film positive is at, or close to, the middle of the stencil 58. Said stencil 58 is then securely, but temporarily, fastened to the film positive by means of tape, registration pins, or the like. Standard register marks on clear tape 25 are placed on the plastic stencil, aligned perfectly with the standard register marks 29 already developed onto the first film positive. The stencil contains several pairs of small holes 27 approximately 3/16"–¼" in diameter, located on both sides of the stencil, and placed at various intervals of distance from the sides to accommodate the differences in the sizes and shapes of the various designs that may be printed. When the appropriate pair of holes is determined, the user fills in that pair of holes with opaque ink, thus placing spots 29*b* directly onto the film positive.

The stencil is then removed from the first film positive, and with the standard register marks on tape now already affixed, is similarly temporarily fastened to the second film positive, once again with the register marks on the stencil aligned perfectly with the register marks on the second film positive. The same pair of holes as on the first film positive are inked onto the second film positive, and so on with as many film positives as are contained in the design. When all the film positives have been marked with the opaque spots 29*b* in the same places, corresponding spots 29*c* are then burned into the screens along with standard register marks

29*a* and the images to be printed contained on the film positives, e.g., image 11*c*. The screens are now each affixed with two burned-in spots 29*c*, i.e., "new" register marks, and may now be used in the registration process, as described herein, avoiding the need for affixing masks.

And as with the masks, said burned-in spots 29*c* and the burned-in standard register marks 29*a* may be permanently covered with emulsion when said screens are used in production, to prevent ink from passing through the holes. (If the user does not want the standard register marks 29*a* to appear on the screen 11 along with the new register marks 29*c*, standard register marks 29 on the film positives may be scraped off, i.e., removed, after marking said film positives with opaque spots 29*b*, and prior to developing them onto the screen. This will leave only the new register marks 29*c* on screen 11.)

Lighting in print shops is often uneven, and because of this, sensors 13*a*, 13*b* may become confused with hot spots or shadows as they move around the machine, and thus may not function properly. To ensure even and consistent lighting passing through the new register marks to the sensors so the readings on the displays will be consistently accurate, sensors 13*a*, 13*b* may be fitted with appropriate filters to compensate for uneven lighting. In addition, or alternatively, a light source may be provided.

Figure 6:
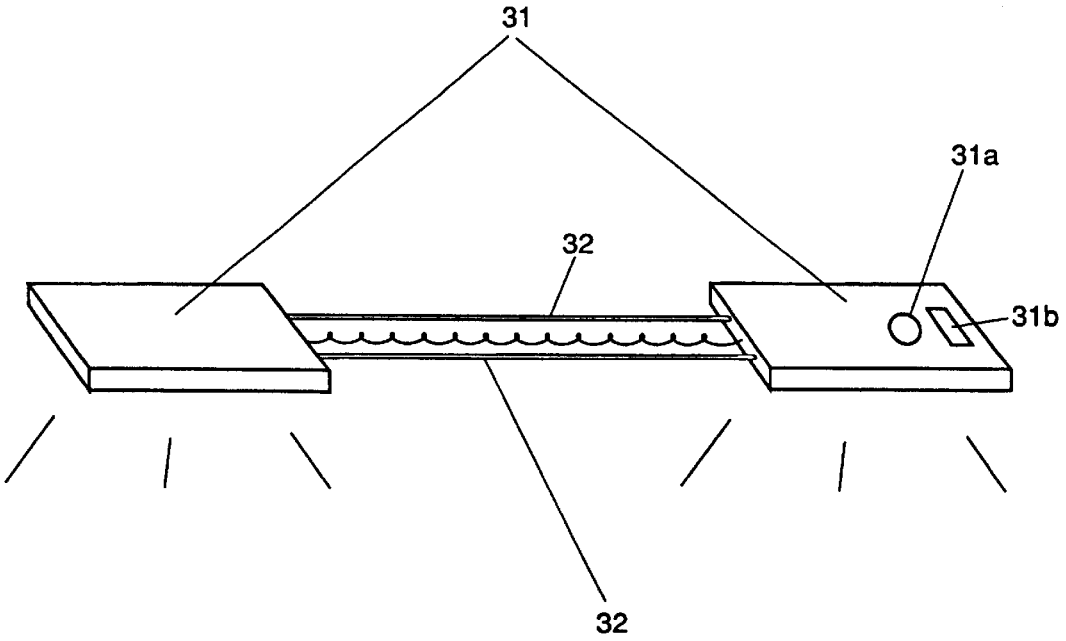
FIG. 6 is a perspective view of a lighting apparatus suitable for use in the present invention.

The light source, which may be called the "light stick" FIG. 6 may include two lights 31 connected by telescoping rods 32 or the like, to accommodate various distances between new register marks. The "light stick" is placed on top of the silk screen 11 (FIG. 1*c* or 5) directly over the new register marks 12*e*, 12*f*, or 29*c* which in turn are positioned directly over sensors 13*a*, 13*b*. The light source may be fitted with a rheostat or "dimmer" 31*a* to enable the user to adjust the intensity of the light passing through the register marks, and an on/off switch 31*b*. The light may be any source of light as long as the light is even and does not produce spots of high, or uneven intensity.

The technology of the apparatus described herein may be adapted to numerous formats, and may be used as either a portable unit for existing machines, able to be moved and used from machine to machine, or as an integrated, built-in feature or option on new machines that are manufactured with this apparatus and technology as a permanent part thereof.

As stated previously, sensors 13*a*, 13*b* may be permanently fixed in a predetermined position in or on a pallet, manually positioned and affixed on a pallet, or built into a pallet and moved by means of a mechanical motion system. In the first instance, it is necessary to take an added step in the screen production process to place, and burn-in register marks on the screens so that they appear in the approximate same position on each screen as the predetermined position of the fixed sensors on the pallet. While this configuration is very efficient, once the screens are produced, it is also time consuming, limited in its application and, with the necessary added step, may negatively affect the degree of accuracy in the registration process. To avoid this extra step, and to accommodate already existing processed screens and designs, and the normally random placement of register marks from design to design, it may be preferable to have the ability to selectively move and position sensors 13*a*, 13*b* underneath the new register marks on a first screen, wherever they may appear, to begin the registration process. This configuration is more flexible and accurate than the fixed sensor configuration, and shall be used in the further description of the present invention.

In the most basic application as a portable unit, the apparatus, as seen in FIG. 2, may be used as is. Sensors 13*a*, 13*b* may be affixed with tape, fixative or the like, to the pallet directly underneath each of the new register marks of the first, base screen, which has been fixed into its frame. Placement of the sensors may be accurately accomplished by placing a tiny drop of ink, chalk or the like on the underside of the screen at the center of the new register marks, then bringing the pallet and the screen together so as to touch, noting where the markings have been transferred to the pallet and then affixing the sensors on top of said markings.

Alternatively, sensors 13*a*, 13*b* may be affixed to rigid telescoping rods, long enough to protrude beyond the boundaries of the screen. Said sensors may then rest on the pallet, be brought together with the screen and then manually and visually moved by means of said rods until they are placed underneath the new register marks on said screen. Again, once accurately positioned, sensors 13*a*, 13*b* may be affixed to the pallet with tape, fixative or the like, or if a metallic pallet is used, be locked into position with magnetic or actuated electromagnetic means. As the pallet with affixed, positioned sensors moves from station to station in the registration process, the housing 24 (FIG. 2) containing the controller and display may be hand held by the user, or be placed and rest on each successive screen, as each screen is registered.

Figure 7A:
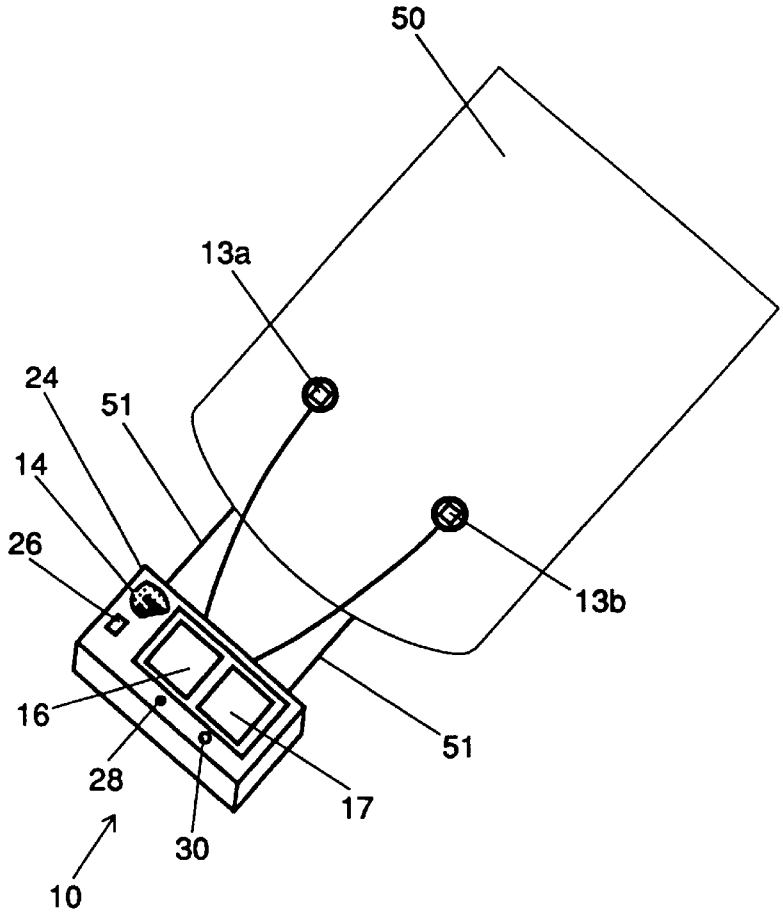
FIG. 7*a* is a perspective view of a pallet with sensors and an attached prepositioning apparatus according to the present invention as an integrated portable unit.

In the most complete and fully integrated embodiment of a portable unit of the apparatus, FIG. 7*a* shows the apparatus 10 joined to a pallet 50, forming a portable unit which may be mounted directly on a screen printing machine, at a station where a normal pallet would be mounted. The sensors may be positioned and affixed to the pallet as described above, for registration, or alternatively, the sensors may be built into the pallet of the unit and moved mechanically (either manually or electrically) by a motion system, for superior sensor stability and ease of positioning use. Two examples of mechanical motion systems will be described later.

In one embodiment of the portable unit FIG. 7*a*, telescoping support rods 51 are coupled from underneath the pallet 50 to the housing 24. Housing 24 may be joined to rods 51 by ball joints enabling the housing 24 to lie flat, or to tilt in a vertical position, if necessary, for clearance, or for convenience. The entire unit is affixed to the machine, and sensors 13*a*, 13*b* are positioned as described above, under the new register marks of the first, base screen. Once the sensors are in a desired position on the pallet, they are fixed in place, such that the position of the new registration marks on the screen in relation to the sensors are illustrated on displays 16, 17, enabling the registration process to begin.

In another embodiment, housing 24 may be on a sliding shelf underneath either the left or right side, or the front of pallet 50, placed according to the configuration of the particular machine. The apparatus 10 can be slid out from under the pallet 50 and twisted, swiveled, lifted and/or tilted as necessary. In both these embodiments of a portable unit, after registration is completed, the housing 24 may be placed back under the pallet so that the pallet may be used in production with the addition of a cover for the pallet, sensors, and optional mechanical motion system.

The complete portable version of this apparatus FIG. 7*a* may contain a flexible and adjustable bolting system underneath the pallet, enabling the apparatus to be attached and utilized on the numerous different and varied machines, both manual and automatic, that are currently on the market and in use. This version may be moved from machine to machine as per the needs of the user, or remain as a "permanent" fixture on an existing machine.

Alternatively, instead of the apparatus being portable, the various components of the apparatus, i.e., the pallet 50, controller 14, displays 16, 17, and sensors 13*a*, 13*b* may be permanently integrated or built into a new silk screen printing machine when manufactured. In this embodiment said various components may be built-in as per the specifications and design of the manufacturer, i.e., the technology may be adapted to fit any desired configuration, e.g., the display and/or the controller may be separated from the pallet, the display made larger, and placed in the center of the machine or on a control arm with the entire system operated from the central control station of the machine.

Additionally, to avoid the potential need for a special light source (the "light stick" as described above), lights may be permanently built into the frames of the machine at each station to ensure even and consistent lighting. The lights may turn on and off automatically as the pallet with the sensors (the registration pallet) moves from station to station.

Figure 7B:
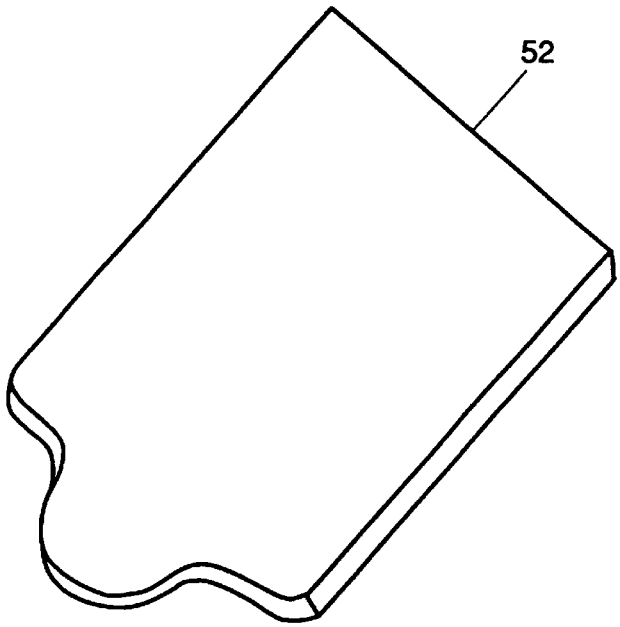
FIG. 7*b* is a perspective view of a cover for the pallet of FIG. 7*a;*

In both the portable and permanent versions of this apparatus, a thin piece of fitted metal, plastic or the like 52 (FIG. 7*b*), may be used as a cover for the pallet containing the sensors and the motion system, if such motion system is a part thereof. After registration is completed, the cover may be affixed, enabling the user to utilize said station in production, i.e., to print on.

As stated above, sensors 13*a*, 13*b* may be built into a pallet and be positioned by means of a mechanical motion system. Said motion system for sensors may be utilized in both the complete portable version of the apparatus (FIG. 7*a*) and the integrated, manufactured version, which is permanently built into a screen printing machine. (It should be noted that the built-in sensors must extend approximately 1/16" above the normal plane of the pallet, or otherwise positioned so as to touch the "new" register marks when brought together with the screen for registration. This prevents ambient light from confusing the sensors.)

Figure 8A:
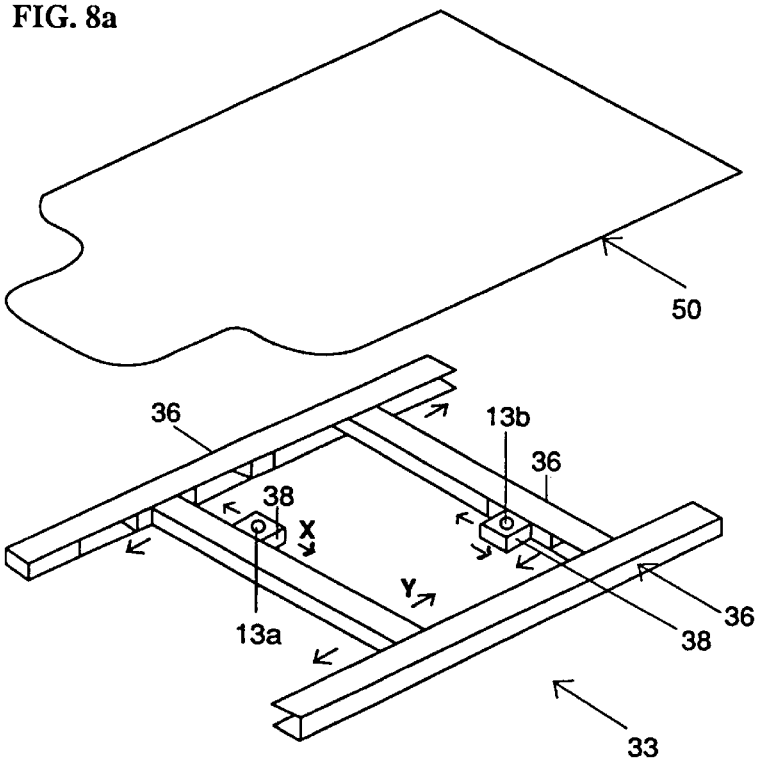
FIG. 8*a* is a perspective view of a screw-rod pallet motion mechanism for moving sensors.
Figure 8B:
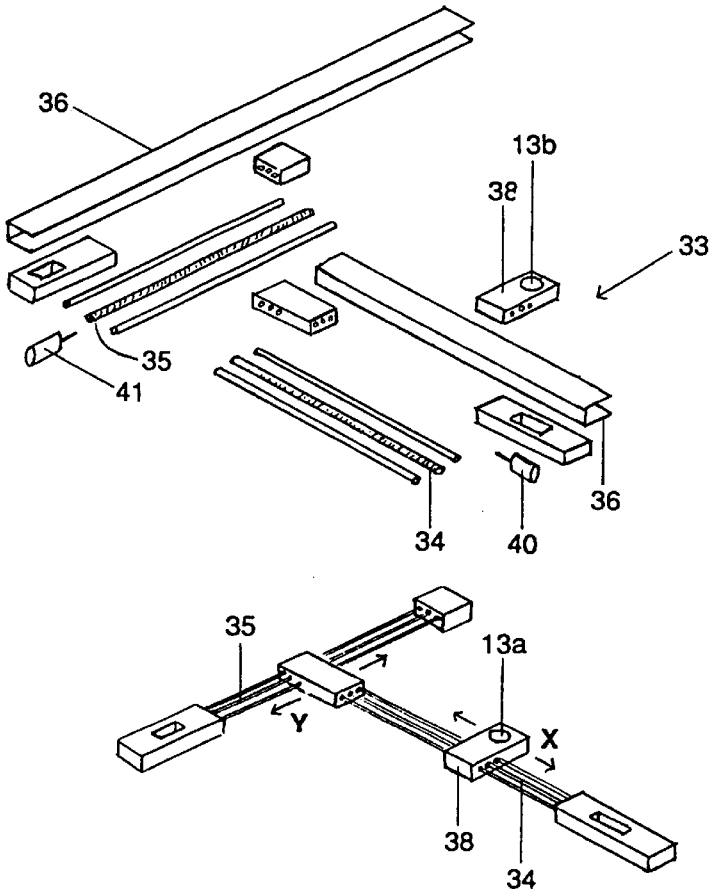
FIG. 8*b* is an exploded view of the screw-rod pallet motion mechanism of FIG. 8*a* for one of the sensors.

FIGS. 8*a* and 8*b* illustrate one embodiment of a mechanical system for moving built-in sensors 13*a*, 13*b* relative to pallet 15 (FIG. 1*c*), or 50 (FIG. 7*a*), so as to move said sensors to a desired position under the new register marks on the first, base screen. As shown in these figures, a mechanism 33 provides a pair of threaded rods 34 and 35, each fixed at both ends within a frame 36 and positioned perpendicular to one another. Sensor 13*a* is coupled to a support member 38, which, in turn, is coupled to rod 34. Sensor support 38 is equipped with a counterpart (not shown) to the threaded portion of the rod 34. One end of rod 34 is integral with and coupled to a motor 40 which turns rod 34 and moves sensor 13*a* and support 38 along the frame 36 in an X or horizontal direction. One end of rod 35 is integral and coupled to another motor 41 which turns rod 35 and moves sensor 13*a* and support 38 along the frame 36 in a Y or vertical direction. A similar system would be used to move sensor 13*b*.

Figure 9A:
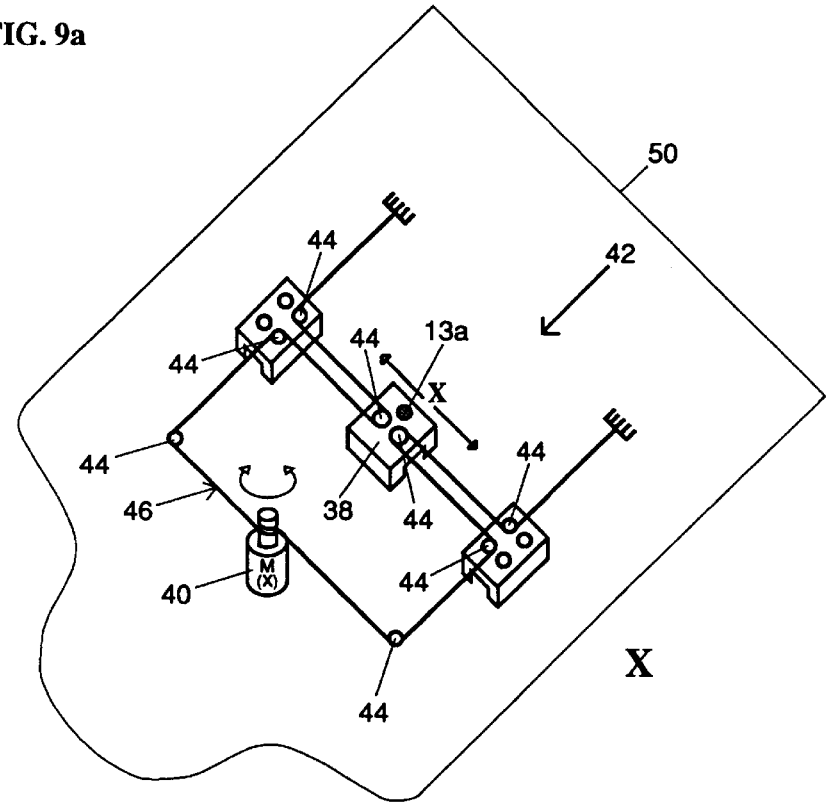
FIGS. 9*a* & 9*b* are perspective views of the x and y wheel and line pallet motion mechanism for moving a sensor.
Figure 9B:
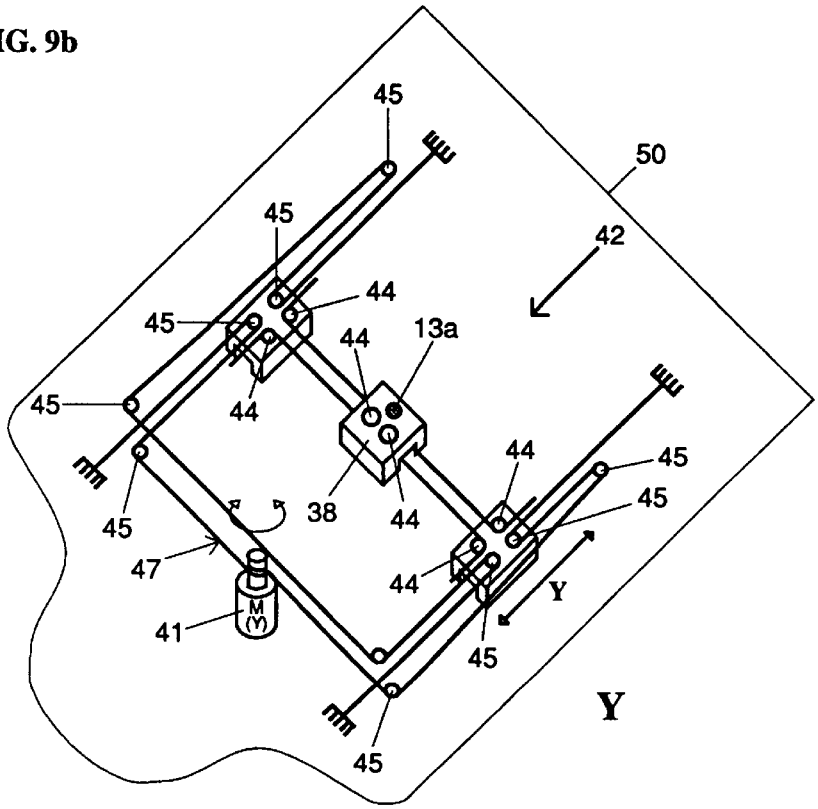

In another embodiment for moving sensors 13*a*, 13*b*, FIGS. 9*a* and 9*b* illustrate a "wheel and line" type mechanism 42 for carrying sensor 13*a*. A substantially identical mechanism moves sensor 13*b*. Mechanism 42 has the same basic design as mechanism 33, except it includes wheels 44, 45 and wire or plastic line 46, 47 arranged in a "clothesline" configuration instead of threaded rod. As motors 40 and 41 turn, wheels 44 and 45 turn, thus moving the lines 46, 47, respectively. The sensor 13*a* and support 38 which is attached to lines 46 and 47, moves in the same manner as in the screw-rod mechanism 33. The wheels 44 and 45 each have a track or groove for guiding the path of the lines 46 and 47, respectively. Also, supports 38 each have one wheel with a track or groove for guiding the supports 38 along the paths of the lines 46 and 47.

Other types of built-in motion systems may be used to move the sensors, including the use of stepper, or self propelled motors to position sensors 13*a*, 13*b*.

In any of these systems, once the sensors 13*a*, 13*b* are appropriately positioned, they may be fixed, or locked in place, so as not to move during the registration process, utilizing standard mechanical locking means, or other like means. Said motion systems may be actuated either electrically, with, e.g., X & Y controls built into the housing of the portable apparatus, built into the screen printing machine at the control center, operated by a wireless remote control box, etc. or manually by means of knobs, cranks, levers, or the like, which may be situated at the sides, or in the front of the pallet containing the sensors and their accompanying motion system.

Said previous embodiments of the present invention have been based on analog technology. In another embodiment of the apparatus and method described herein, a "digital" system is employed. Here two digital imaging sensors are used, instead of the analog sensors of the previous embodiments. These sensors are generally referred to as CCD sensors (Charge Coupled Diodes), are commonly used in video cameras and camcorders, and have the ability to convert an image to digital data, i.e., they digitize the image. In this embodiment, the digitized image data is processed by the controller, and sent to the display. In this way a positional image, or "picture" is generated on the display, rather than a positional point, as with the analog system.

The particular image on the display, is determined by the software contained in the microcontroller, which converts the shape of each new register mark into a desired format to be transmitted to, and seen on the associated display. Thus the new register marks may be virtually any shape, and the images on the display may be the same shape, or virtually any other shape, subject to the instructions of the software, and subject to the choice, or physical limitations, of the display. E.g., if the new register mark is circular in shape, the image on the display may also be circular, or any other shape desired, i.e., square, triangular, irregular, the configuration of a standard register mark etc.

Figure 10:
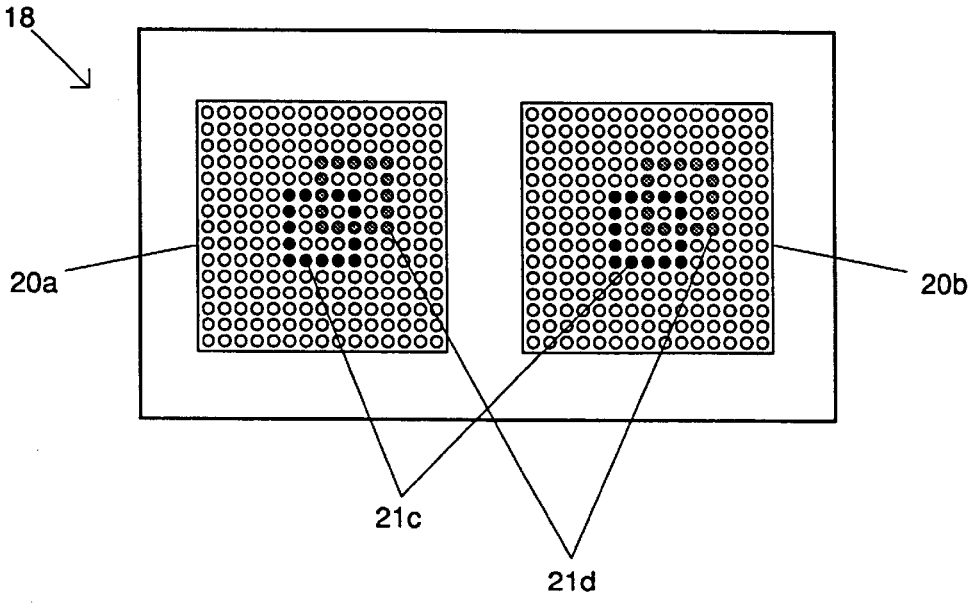
FIG. 10 illustrates a generated image on a display.

And though the sensors and software in this embodiment are different from the previous embodiment, this system functions, and is used in the same manner as the analog system. Thus, e.g., if the apparatus is programmed to utilize a generally circular new register mark, and create an image of a square outline on the display therefrom, new register marks would first be affixed to screens as with the analog system, i.e., with masks or by burning in new register marks directly onto the screens with the stencil system. The CCD sensors would be positioned under the new register marks on the first, base screen. Light passes through the holes in the new register marks onto the sensors. The control means processes the data, locates the position of the light spot on the sensors, and transmits this information to the display, which in turn displays the positional information in the form of a square outline of actuated or lit indicators, e.g., LEDs 21*c* (FIG. 10).

And again, as with the analog system, the hold button is actuated storing the coordinates of the image, which may turn the square outline of indicators from green to red, and keep them so illuminated throughout the registration process as first indicia. Subsequent screens are registered to the first screen by superimposing the square of positional lit green indicators, or second indicia, created on the display by the new register marks of said subsequent screens 21*d*, onto the square of fixed lit red indicators 21*c*, fixed from the first, base screen. This occurs when the sensed coordinates equal the stored coordinates.

Figure 13B:
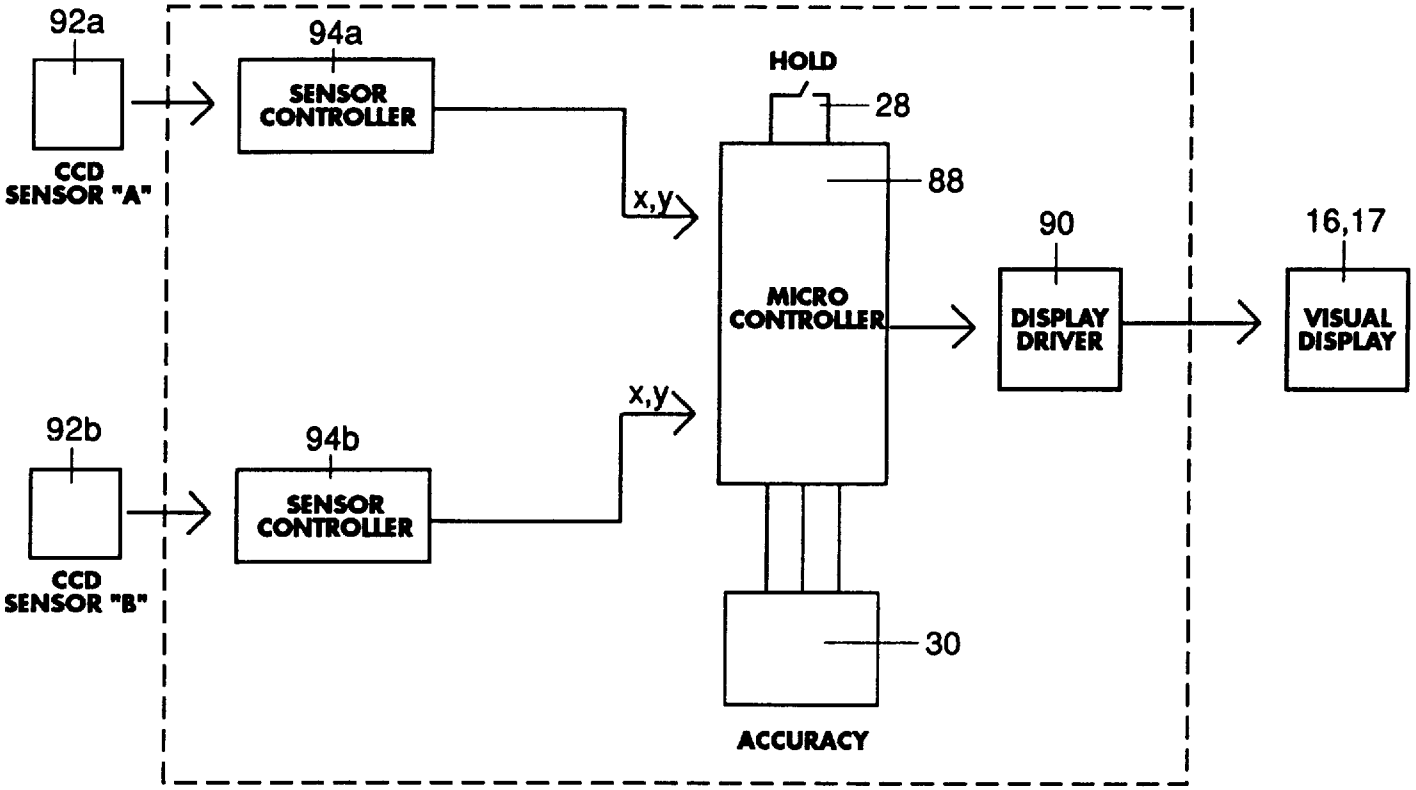
FIG. 13*b* is a block diagram of a digital circuit version of an apparatus which converts sensor signals to drive a display.

FIG. 13*b* is a block diagram of an alternate embodiment of the apparatus in which an imaging sensor, such as a CCD chip is employed. Each of the CCD sensors 92*a*, 92*b* is controlled by a suitable sensor controller 94*a*, 94*b* which can provide digital inputs to the microcontroller 88. The remainder of the circuit is substantially identical to the circuits of FIG. 13*a*, in that the X, Y outputs of the sensor controllers, 94*a*, 94*b* enable similar computations to cause the display driver 90 to control the display 16, 17, in substantially the same fashion as in FIG. 13*a*.

In this embodiment, the microcontroller 88 must analyze the image of the light spot, determine the center or centroid, and locate it in terms of X & Y coordinates for the purpose of displaying a location on the display 16, 17.

Again, while this system utilizes a different technology (digital vs. analog), the creation of new register marks, the use of masks, the stencil system, some of the display embodiments, the description of use, and method of operation etc. for both systems is essentially the same, as previously described in this disclosure.

It has been shown that the analog system can display any movement of a spot of light on the sensor's surface in an X & Y axis (and by extension any movement of the silk screen in an X & Y axis). To accommodate movement (and registration) on a rotary axis in this system, it is necessary to use at least two spaced apart register marks and align them both (as with standard registration with standard registration marks).

Figure 11A:
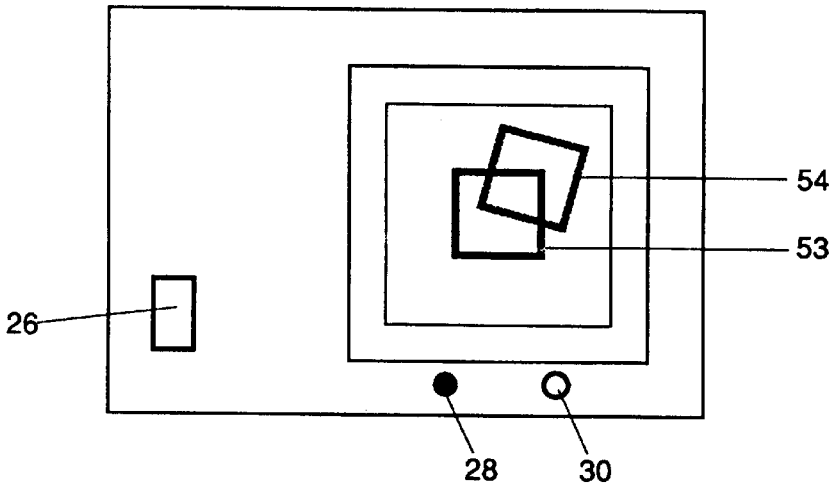
FIG. 11*a–c* illustrates registration using the generated images of FIG. 10.
Figure 11B:
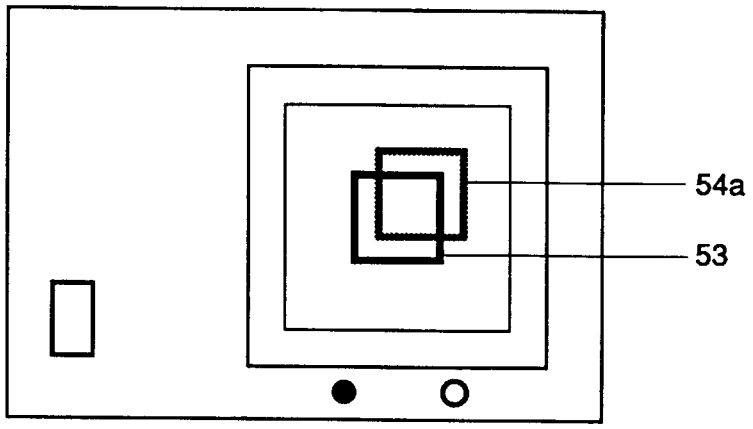
Figure 11C:
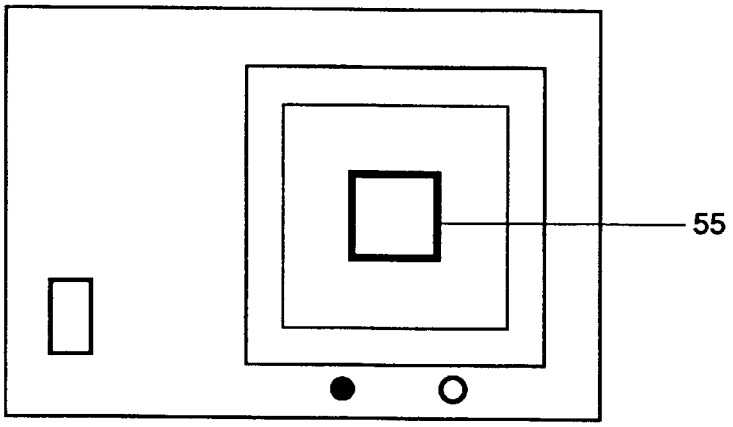

And though the digital system is also intended to be used with two spaced apart new register marks, an advantage of this system is that it may be possible to use it with only one register mark, one sensor, and one display, and still accomplish excellent registration as shown in FIGS. 11*a–c*.

Since the end result of using this system is a generated image, or "picture", the display has the ability to show movement of the image in all directions, i.e., X, Y and on a rotary axis. By utilizing any shape other than circular for the new register mark (a single circular new register mark will not allow the apparatus to distinguish movement of the screen on a rotary axis), e.g., a square or triangle, and by creating, by means of the software, any image other than circular on the display e.g., a square outline, movement of the new register mark, and by extension the screen, will be accurately reflected on the display in all directions, thus avoiding the need for a second register mark to accommodate the rotary axis.

Thus, if the first fixed image 53 from the base screen is level (having positioned the screen such that the image is level), and a subsequent image 54 from a subsequent screen is off level or "crooked", the user will be able to see this juxtaposition on the display, "straighten" the subsequent screen image 54*a* first, to make it level, and then move it on the X & Y axes until the subsequent image 54*a* is superimposed on the first, fixed image to form a composite image 55, as shown in FIGS. 11*b* and 11*c*. In this way, registration may be accomplished by using only one sensor, one new register mark, and one display.

It should be noted that use of this digital, single image format may require the use of specific displays for optimum performance, in order to clearly see, and register the images. For example, to avoid too much "pixeling", a larger matrix of LEDs may be used. Further, a programmed LCD, or T.V. monitor may be used, displaying virtually any image or shape which may be utilized as the "register marks". Conversely, displays like the "cross hair" or numerical display may not be used as they cannot create an image, or "picture".

Further, to minimize screen variation due to stretching, warping etc., and to increase the accuracy of this format, metal framed screens such as Neuman Roller Frames may be used. These screens are adjustable, heavy, and not as subject to the variations seen in wooden screens. Since they are more expensive than wooden screens, they are normally used by printers only with the most difficult and intricate designs, but use of this type of screen would seem appropriate for the single image digital system.

DESCRIPTION OF USE

Figure 1C:
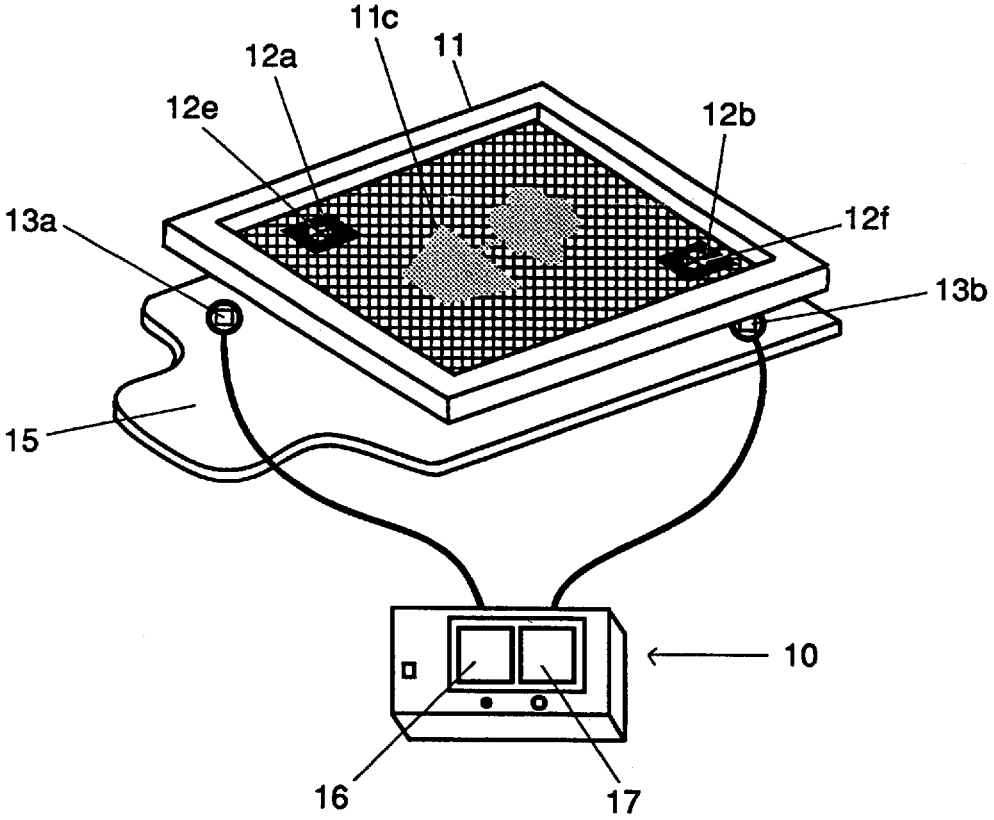
FIG. 1*c* is a perspective view of the apparatus of the present invention for registering printing screens, with a pallet and a screen with "new" register marks using masks affixed thereto.
Figure 1D:
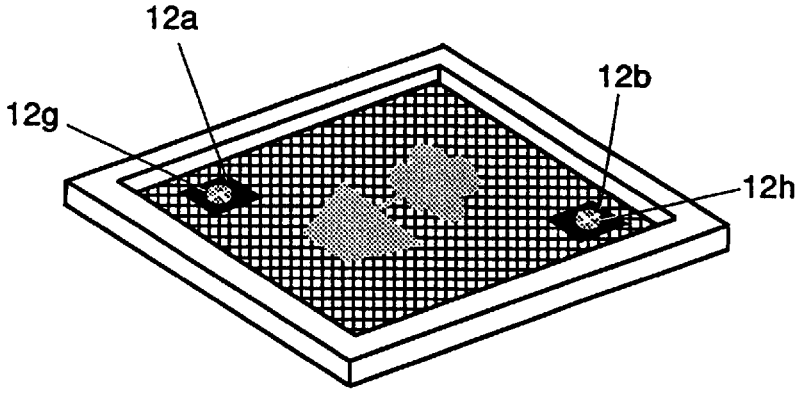
FIG. 1*d* is a perspective view of the screen of FIG. 1*c* with "new" register marks using masks affixed thereto, with taped register marks removed.
Figure 14A:
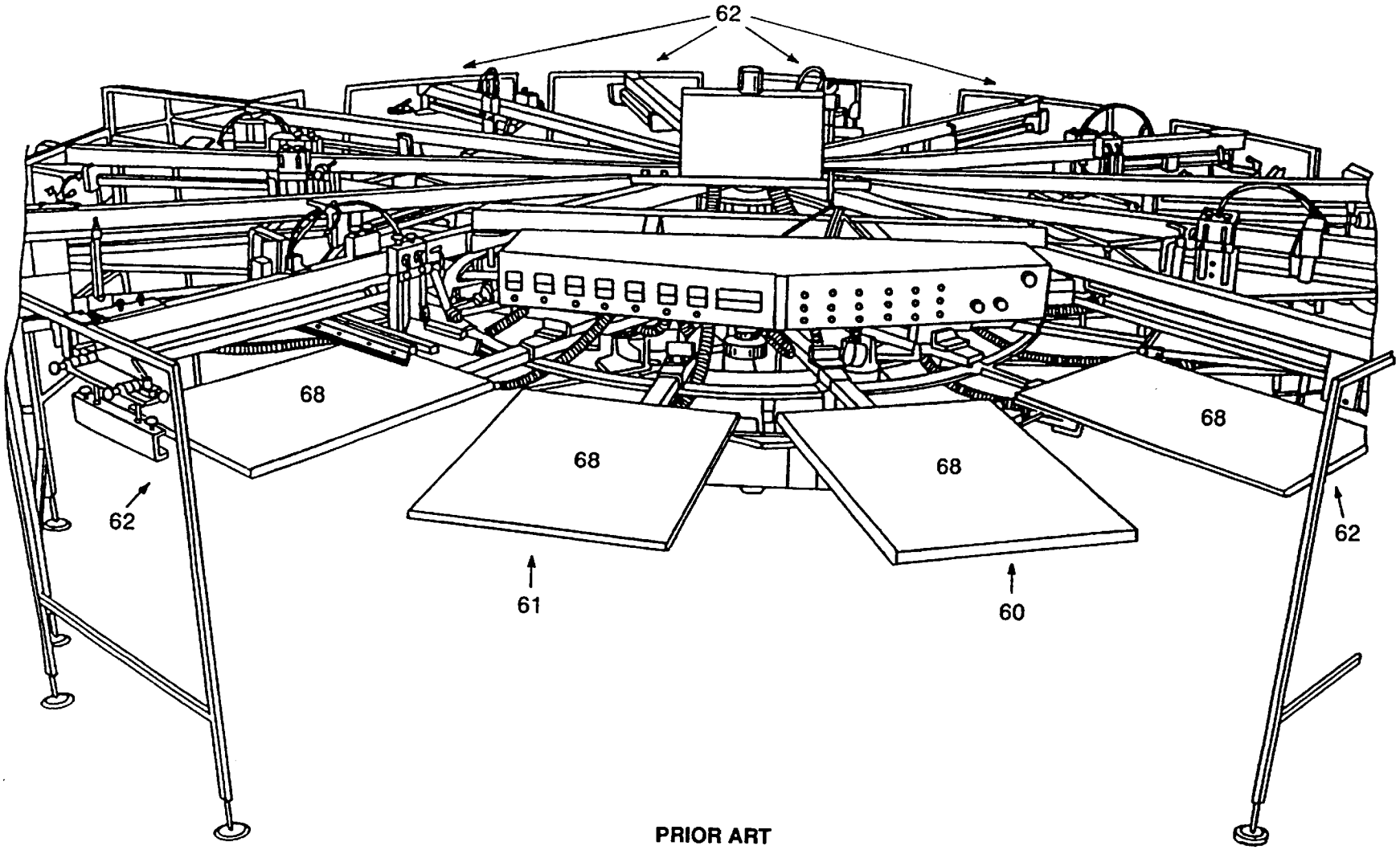
PRIOR ART FIG. 14a
FIG. 14*a* is a perspective view of a typical prior art multi-station screen printing machine.
Figure 14B:
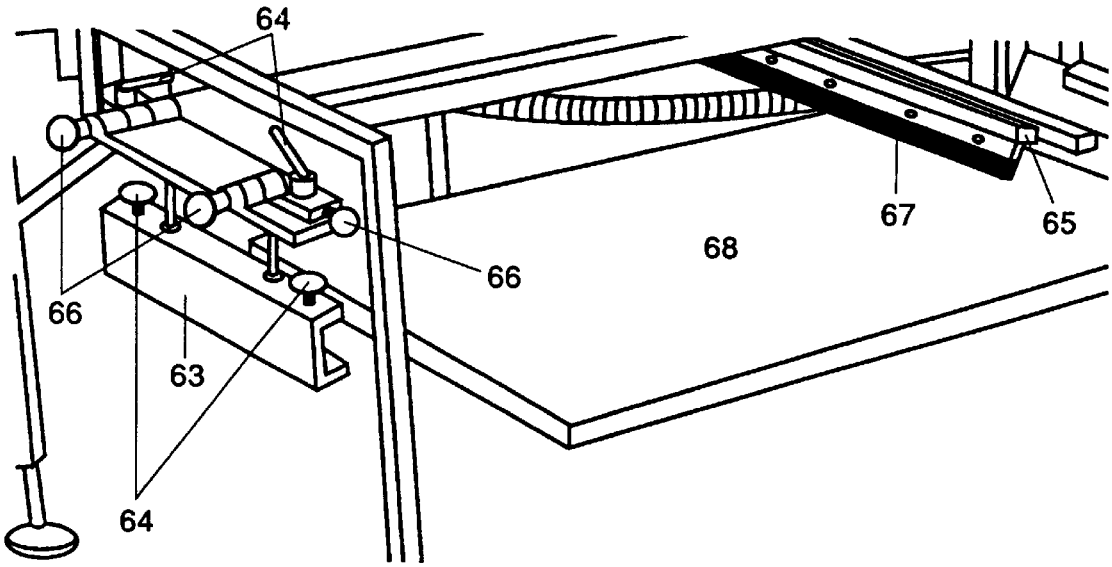
FIG. 14*b* is an enlarged view of one station of the machine of FIG. 14*a*.

FIG. 1*c* represents the primary components that may be used in conjunction with a station of a multiple station screen printing machine as shown in FIG. 14*b*. It should be remembered that in practice, pallet 15 (68) is mounted on the machine and moves sequentially around said machine, and screen 11 is locked into a frame 63, on the machine, said frame including an associated "squeegee" 67, for forcing ink through the screen.

As can be seen in FIG. 1*c*, sensors 13*a*, 13*b* are moved, either manually or mechanically, underneath the new register marks 12*e*, 12*f* on first, base screen 11. The pallet with the sensors is brought together with the screen so as to touch. Light passes through the new register marks, and onto sensors 13*a*, 13*b* thus determining the relative position of the new register marks 12*e*, 12*f* on screen 11 to the sensors 13*a*, 13*b*.

The positional information is transmitted from the sensors to the controller 14 (FIG. 2), where it is analyzed, processed, and in turn transmitted to the display so as to be seen on displays 16, 17, in the form of lit LEDs. In this manner, a visual representation of the position of the new register marks 12*e*, 12*f* (FIG. 1*c*) and thus screen 11, relative to the sensors 13*a*, 13*b* can be seen on the displays 16, 17.

When the user is satisfied with the position of the sensors 13*a*, 13*b* relative to the screen 11 and new register marks 12*e*, 12*f* (FIG. 1*c*), or 12*g*, 12*h* (FIG. 1*d*), the sensors are locked or fixed in position and the "hold" button 28 is actuated, causing the controller to store the location coordinates of the light spots on the sensors. In the preferred embodiment, this keeps particular LEDs lit, as first indicia, throughout the registration process, said LEDs representing the position of the new register marks on the sensors, from the first, base screen. As seen in FIG. 3 one LED 21*a* would be lit in display 20*a* associated with sensor 13*a*, and one LED 21*a* would be lit in display 20*b* associated with sensor 13*b*. As noted above, the hold button 28, when activated, may also change the color of the LEDs from a first color to a second color, i.e., from green to red.

As can be seen, the first screen 11 (FIG. 1*c*) is not moved. Rather the screen 11, having been mounted on the machine along with all the others, is locked in a desired position and the sensors 13*a*, 13*b* are moved underneath and brought together with the screen, until the LEDs are in the lit position desired by the user. Then the sensors are locked in place relative to the pallet.

All subsequent screens are now registered to match the position of the lit LEDs which have been fixed in place, i.e., subsequent screens are registered and aligned relative to the new register marks 12*e*, 12*f*, (or 12*g*, 12*h*) on the first screen 11 (FIG. 1*c*).

Specifically, the pallet containing the locked and positioned sensors is moved to the next station under the new register marks of the second screen, and once again, brought together so as to touch said second screen. A light spot then passes through each new register mark on the second screen and onto sensors 13*a*, 13*b*. LEDs having the first color (green) appear on the display 21*b* (FIG. 3), as second indicia, and demonstrate the position of the second screen relative to the sensors 13*a*, 13*b* and thus relative to the lit red LEDs fixed in position from the first screen 21*a*. The user then moves the second screen until the moving green LEDs from the second screen are superimposed over the red LEDs that have been fixed in place by the hold button 28 from the first, base screen. When this occurs, the coinciding red and green LEDs may appear to change to orange. This indicates that the sensed coordinates equal the stored coordinates and that the position of the register marks on the second screen are in the same relative position to the sensors 13*a*, 13*b* as on the first screen, and thus the second screen is in the same relative position as the first, base screen. The second screen is then locked into position and is registered to the first screen.

The pallet with the fixed and positioned sensors is then sequentially moved under each of the screens in the series, and each successive screen follows the same process, with the register marks on those screens being brought into alignment with the register marks on the first screen by superimposing the lit LEDs (green) from each successive screen to the first, locked-in LEDs (red). When all screens have been registered to the first screen, the process is complete and the design is ready for printing.

One advantage of the registration apparatus 10 (FIG. 2) of the present invention and/or its technology is that the user may greatly shorten and facilitate the registration process necessary in screen printing. Another advantage of the present invention is that it is relatively inexpensive and easy to use. Still another advantage is that, since it may be portable, it can be incorporated and used with most of the screen printing machines currently in use, or available, avoiding the need to purchase expensive new machinery.

Yet another advantage of the present invention is that screen warp or stretch can be determined from screen to screen, as discrepancies in any of the screens will become readily apparent visually, said discrepancies easily seen on the display, allowing the user to readily make appropriate adjustments.

To explain this more fully: Most silk screens are made by tightly stretching a fine mesh across a wooden frame. After repeated use, it is not uncommon for the mesh to loosen or stretch slightly, or for the wood to warp, resulting in the likelihood that one or more of the screens will not register with the others. If this condition is severe, the screen must be replaced. But if it is slight, as in most instances, adequate registration is still able to be achieved, with the apparatus described herein.

Completely automatic registration systems may preposition screens exactly the same way, every time, as per the position of the reference marker(s) they use on the screens. If a screen has stretched, relaxed or warped, it may automatically preposition the screen in the same place as if it were not stretched, thus potentially making the print "out of register". In the illustrated apparatus, since registration is achieved visually, not automatically, when registration is checked, the user will readily see if a screen has stretched because the display indicators on subsequent screens will not match perfectly with the display indicators of the first, base screen. Thus, such screens can either be replaced or a screen position can be properly adjusted, compensated or "averaged" to ensure adequate registration.

Figure 12A:
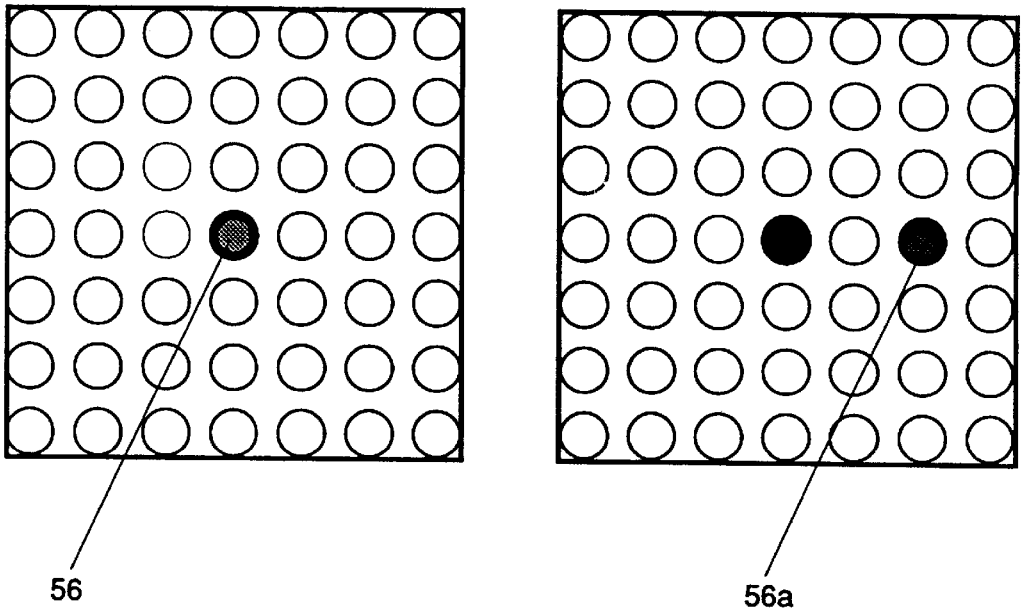
FIGS. 12*a* & 12*b* illustrate the use of an "averaging" technique to display the relative position of a screen.
Figure 12B:
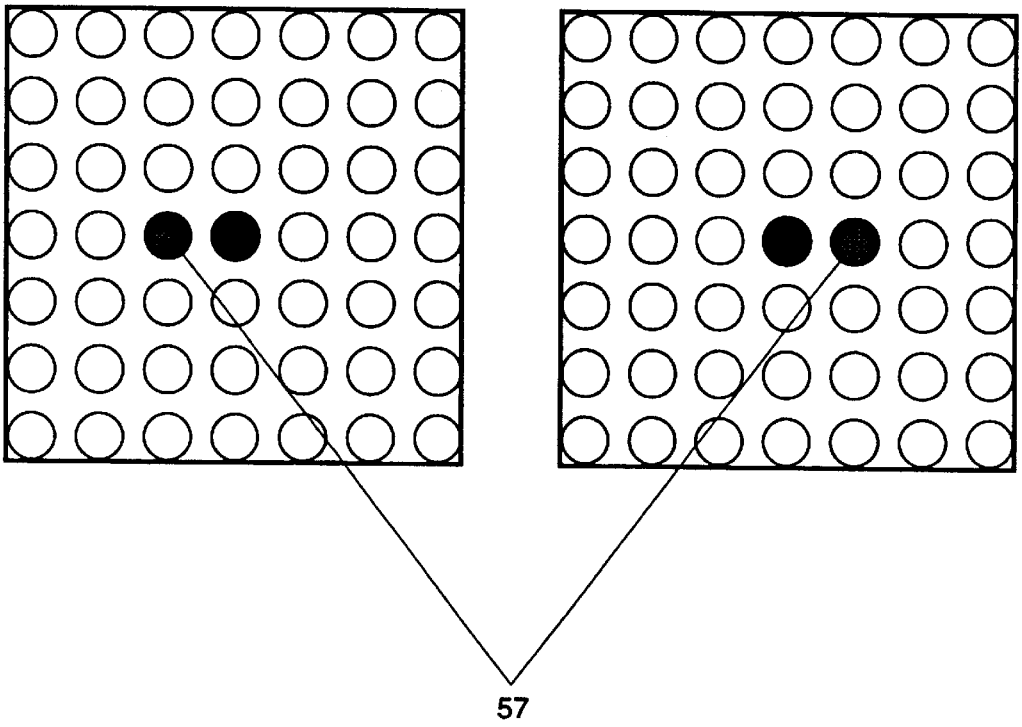

To illustrate the above (FIG. 12*a* & 12*b*), in the preferred embodiment, after the hold button has been actuated for the first, base screen, fixing two indicators (red), on each display, the second screen's indicators (green) will appear on the displays. If the screen has stretched, the left display may show, e.g., the green indicator superimposed on the red 56, while at the same time the other display may show the green indicator 56*a* displaced or "off" by two indicators to the right. The user may then move the screen so that the left display will show the green indicator 57 displaced by one to the left of the red indicator, and the other, displaced by one to the right, thus "averaging" the discrepancy. In most cases, this will enable the design to be adequately registered and printed. (Of course, if the first, base screen has stretched or warped, it should be replaced.)

The flexibility of the apparatus and method described herein, i.e., its numerous formats and applications, provides another advantage over existing systems. E.G., the system may be integrated into a new machine as a permanent part thereof, or used in portable format with existing machines. Also, instead of the sensors being movable to accommodate random placement of register marks on screens, sensors may be permanently and selectively fixed in, or on, a pallet, and new screens produced so that register marks appear in the approximate same position on each screen as the predetermined position of the fixed sensors on the pallet, thus avoiding the need for motion systems for moving sensors.

Additionally, though the present invention has been described for use with a multiple station screen printing machine, its technology is readily adaptable to align multiple successive screens on a single station screen printing apparatus, typically used in the production of graphic works of art, printed circuit boards and the like.

These and other advantages are all within the scope of the present invention.

While this invention has been particularly shown and described in reference to the preferred embodiment and drawings, it will be understood by those having skill in the art that changes in form and detail may be made without departing from the spirit and scope of the invention. Further, it is noted that the broadest applications of the apparatus and method have been presented herein, and that obvious variations exist that may not be specifically described, or developed. The following are some examples:

When using the apparatus of the present invention in an automated printing system, typically, the screens are stationary and the pallets (with the sensors) and/or with the material to be printed, are rotated from screen station to screen station. When using the apparatus in a typical manual carousel, often times the pallet remains stationary, while the screens are rotated and printed in series.

While most automatic and semi-automatic machines operate by having the pallets rise at each station to come into close proximity to the screens and then move down to then proceed to the next station, there may be other machines wherein the screens move up and down, while the pallets remain level as they move around the machine from station to station.

The apparatus described herein, presently measures approximately 9"×6"×2", but these measurements may vary considerably when the apparatus is manufactured and utilized in the many configurations described in this disclosure. For example, when used as an integrated part of a newly manufactured printing machine, the display may be substantially larger and be situated apart from the other components of the apparatus. Conversely, with the use of printed circuit boards and other mass production advantages, the apparatus may be made considerably smaller, making it easier to use, especially in the portable embodiments.

The apparatus 10 in FIGS. 1*a*, 1*c* and 7*a*, as well as the masks and the register marks in FIGS. 1*a*, 1*c*, 1*d* and 5 are not drawn to scale with the screen and/or the sensors and pallet, as doing so would make them too small to see clearly. Instead, they have been enlarged for demonstration purposes and for the sake of adequately describing their appearance, use, configuration, position etc. This does not affect the accuracy or substance of this disclosure in any way. Typical dimensions of the various components comprising the apparatus and method described herein are given throughout this disclosure, and these should be used to determine the true proportions of said various components.

Since sensors 13*a*, 13*b* have the ability to analyze and determine where the X & Y coordinates of a light spot, i.e., where the X & Y coordinates of the openings in the masks, intersect, virtually any shape of opening may be used, as the sensors will compute their essential "center" and determine the position of each said center on each sensor. But for ease of use, and continuity with the general shape of a standard register mark, a generally circular opening is preferable.

Since 13*a*, 13*b* must be brought together to touch the new register marks on a screen (to keep out ambient light from confusing the sensors), it may be necessary to ensure that this is easily and readily accomplished. Most screen printing machines are manufactured so that the pallets at each station are adjustable in the vertical plane and thus, may be raised and lowered with the sensors attached, or as a part thereof. This can, in most cases, achieve the necessary positional relationship between sensors and new register marks. But, as an alternative and/or adjunct to the above, said sensors may be built into a pallet or a motion system with a spring-loaded mechanism attached thereto, enabling the user to adjust, i.e. raise and lower the sensors appropriately to the desired elevation. Further, in the motion system embodiments, the entire mechanism with integrated sensors 13*a*, 13*b* may be raised and lowered by simple mechanical means utilizing a lever, crank or the like.

Finally, though this apparatus has been developed primarily to be used in the silk screen printing industry, in print shops which generally utilize multi-station machines, the technology of the apparatus may be adaptable to serve the purposes and improve upon the prior art of any other industry whose final product requires extremely accurate and consistent registration or alignment to be viable and successful.

One such application of the technology of the present invention may be in the production of multi-layered printed circuit boards ("PCB"s), normally used to provide electrical circuits to operate electronic devices of all types. Typically, PCBs may be silk screened with layers of different electronic circuits, in metallic inks that can conduct electricity, one layer at a time at sequential intervals, on a single station silk screen printing machine.

Thus, a rigid work piece, which may be made of plastic, ceramic, or other durable material is positioned in a conforming receptacle. A silk screen with an electronic circuit pattern burned-in, is brought into contact with the work piece, and metallic conducting ink, which may contain gold, silver or other precious metals and the like, is "squeegeed" through the screen and onto the work piece. The work piece with the now-printed circuit may then be removed from the printing apparatus, to be processed and treated appropriately so as to make it viable and permanent, sometimes heating it to extremely high temperatures for many hours.

The printed work piece is then placed back into the conforming receptacle, in the essentially same position as before, to be printed with a second screen which may contain a different burned-in electrical circuit and may be used with a different metallic conducting ink. The second printed circuit, must be perfectly registered to the first, fixed printed circuit (and likewise for as many layered circuits as may be contained on the PCB), or not operate properly, many times having to be discarded as a reject.

It may be seen that alignment errors in the production of PCBs may be extremely time consuming, wasteful and costly, due to the step by step time-intensive processing and the expensive inks. A multi-layered PCB may take days to reach its final "print" (layer), only to be discarded if the final circuit is out of register with any of the other layered circuits.

Since the technology of the present invention is extremely flexible, adaptable, accurate and consistent, it may well be applied to the manufacturing of PCBs, and may be integrated into the printing machines used for that purpose.

Thus, as with multi-station screen printing described in this disclosure, the location coordinates of the new register marks from a first screen may be shown on a display by means of lit LEDs or the like and fixed (stored). Subsequent screens may be accurately aligned and positioned by matching the displayed LEDs from the position of the current screen, to the fixed LEDs from the first screen, which may be stored and retrieved as desired.

Indeed, since the work piece is also removed and replaced as each layer is added, it may be desirable to incorporate a second registration system of the present technology into the printing machine to ensure that the work piece is placed in register with its prior position on the machine, each time it is placed back on the machine. Thus, the first position of the work piece would be reflected on a separate display, by means of fixed, stored, lit indicators, to be matched by indicators produced by future placements of the work piece.

Further, the technology of the present invention may be adapted to align masks such as are used in semiconductor production, in general, and in the production of large scale integrated (LSI) circuits in particular. As is known, such circuits are produced using photographic methods in which each mask of the set must be aligned to be in registration so that the various layers of the semiconductor can be properly fabricated. The work piece, with a photosensitive emulsion, is exposed and "developed" leaving areas available for treatment such as etching, oxide deposition and doping.

In both of these applications, it is the technology and concept of aligning the elements to a selected reference point, rather than to a fixed reference point that may provide greater flexibility, cost effectiveness and ease of use.

Accordingly, the present invention is not limited to the precise arrangements or applications described in the foregoing detailed description.

What is claimed as new is:

1. Apparatus for prepositioning a series of at least two print screens on a silk screen printing machine by displaying the location of a light pattern applied to a sensor, comprising in combination:

a. at least two print screens, each having alignment means to enable registration with each other;

b. sensor means capable of signalling the location of a light pattern impinging on said sensor means, said light pattern corresponding to the location of the alignment means;

c. data processing means coupled to said sensor means and responsive to signals therefrom for generating display signals, including signal storage means for holding display signals representing the location of a selected light pattern corresponding to said alignment means;

d. actuatable means coupled to said data processing means for storing selected display signals in said storage means; and e. display means coupled to said data processing means, said display means having a first display mode responsive to the stored display signals for providing a first visual presentation corresponding to and representative of the location of a selected alignment means corresponding to the stored display signals held in said storage means from one of said screens, and a second display mode responsive to currently generated display signals for providing a second visual presentation representative of the location of an impinging light pattern, corresponding to and representative of the alignment means then being applied to said sensor means, whereby with manipulation of the other of said screens, the first mode presentation, representing the position of said one screen, and the second mode presentation, representing the position of the other of said screens, are brought into super-imposing correspondence which indicates that the selected light pattern corresponding to and representative of a prior location of said selected alignment means from said one screen and the present location of the impinging light pattern corresponding to and representative of the present location of the alignment means from a currently presented other screen, are in a predetermined alignment.

2. Apparatus as in claim 1, wherein said sensor means includes a CCD device capable of signalling the boundaries of the light pattern, and wherein said display means is capable of providing a visual representation of the screen alignment means, the boundaries of which are being signalled.

3. Apparatus as in claim 1, wherein said sensor means includes a PIN device capable of signalling the orthogonal coordinates of a centroid of the light pattern, corresponding to the location of said alignment means and wherein said display means is capable of providing a visual representation of the location of a screen alignment means light pattern.

4. Apparatus as in claim 1, wherein said sensor means include first and second sensors, each responsive to a light pattern, corresponding to said alignment means, to signal to said data processing means the location of said alignment means relative to said first and second sensors; and wherein said display means include first and second displays, each respectively representing the light patterns on said first and second sensors.

5. Apparatus as in claim 4, wherein said sensors are PIN devices, each capable of signalling the orthogonal coordinates of a centroid of the light pattern corresponding to said alignment means and wherein each of said displays is capable of providing a visual representation of the location of the light pattern impinging upon the respective sensor.

6. The apparatus of claim 1 wherein said first display mode is in a first color and said second display mode is in a second color, said display modes for subsequent screens being said second color.

7. The apparatus of claim 1 wherein said first display mode is a first display state and said second display mode is a second display state, one of said states being an intermittent light emission and the other state being a steady light emission.

8. The apparatus of claim 1 wherein said alignment means includes an opaque area with a central opening.

9. The apparatus of claim 8 wherein said opaque area of said alignment means is provided by a layer of opaque emulsion on said screen.

10. The apparatus of claim 8 wherein said alignment means opaque area is in the form of a separate sheet of material that is secured to its associated screen.

11. The system of claim 1 wherein each of said alignment means comprises a generally translucent area surrounding a generally transparent opening through which light can pass.

12. The apparatus of claim 1 where said display means are selected from the group consisting of LEDs, LCDs, TV monitors, and electric lamps.

13. A method for aligning on a silk screen printing machine a series of silk screens each having registration markers to assure registration of the composite print to be produced from the series of screens, comprising the steps of:

a. applying a first light pattern corresponding to a first registration marker from a first screen to a sensor having a sensitive area capable of signalling relative location of light pattern impingement;

b. processing said sensor signals to create a visual display corresponding to the location of said first light pattern relative to the sensitive area of the sensor;

c. selectively storing processed sensor signals corresponding to the location of said first light pattern;

d. displaying, in a first distinctive display mode, a representation of the first light pattern location corresponding to said stored processed sensor signals;

e. applying to said sensor a second light pattern, corresponding to a registration marker from a next screen of the series;

f. processing sensor signals resulting from said second light pattern to create a visual display corresponding to the location of the next screen light pattern;

g. displaying, in a second distinctive display mode, a representation of the location of the next screen light pattern from said processed sensor signals, corresponding to said next screen light pattern;

h. manipulating the screen providing the second light pattern until the light pattern as represented by the visual display in the second distinctive mode corresponds in a predetermined manner with the visual display in the first distinctive mode, whereby when the first and second distinctive display modes correspond in the predetermined manner, the registration markers of the first and next screens are also in a predetermined correspondence.

14. The method of claim 13 wherein the first distinctive display mode is a first color and wherein the second distinctive display mode is a color different from said first color.

15. The method of claim 13 wherein one of the distinctive display modes is an interrupted flashing display and wherein the other of the distinctive display modes is a steady state continuous display.

16. The method of claim 13, wherein the sensor includes a CCD device capable of signalling the boundaries of an impinging light pattern corresponding to a registration marker and wherein said display provides a visual representation of the boundaries of the impinging light pattern.

17. The method of claim 13, wherein the sensor include a PIN device capable of signalling the orthogonal coordinates of the centroid of an impinging light pattern corresponding to a registration marker and wherein said display is capable of providing a visual representation of the relative location of impinging light patterns in said first and second distinctive modes.

18. The method of claim 13, wherein the sensor include first and second sensors, each responsive to a separate applied light pattern, and wherein said display includes first and second displays, each respectively displaying the relative location of the patterns signalled by said first and second sensors.

19. The method of claim 18, wherein said sensors are PIN devices, each capable of signalling the orthogonal coordinates of a centroid of an impinging light pattern and wherein each of said displays is capable of providing a visual representation of the location of the light pattern impinging upon the respective sensor.

20. The combination of a screen printing machine, a series of at least two print screens, and apparatus for quickly and economically prepositioning the print screens on the machine, the combination comprising:

a) at least two print screens, namely a first screen and at least one subsequent screen, each having a print area for printing a portion of a composite print graphic, the machine being operable to use prepositioned print screens to sequentially print the print portions onto a print surface of a work piece in the correct spatial relationship to create the composite print graphic, and to essentially repeat said sequential printing for a production run of such work pieces, each screen having locating marker means including at least one marker that allows a predetermined minimum amount of light to pass through, the marker being so positioned relative to its respective print area that if the screens were each positioned over the print surface with the markers in the same spatial orientation with regard to the print surface, the print portions produced by the print areas would be in register so as to provide the desired composite print graphic on the print surface;

b) a machine frame;

c) screen holding means on said frame for holding the print screens in position for printing;

d) work piece holding means for holding a work piece with its print surface adjacent a screen;

e) adjusting means on the frame for changing and locking the spatial orientation of a print screen relative to said screen holding means;

f) light sensing locating means including at least one sensing element mounted on said work piece holding means, said sensing element being operable in response to at least the predetermined amount of light passing through the associated marker of said first screen to generate first electrical signals that represent the essentially exact location, relative to said sensing element, of the light passing through such marker and the location of said first screen relative to the work piece holding means;

g) control means electrically coupled to said light sensing locating means, including storage means for selectively storing first signals corresponding to the coordinates of the location of the marker of said first screen;

h) display means electrically coupled to said control means for receiving said first signals, processing said first signals and generating and sending to said display means electrical display signals, related to said first signals, said display signals each producing a positional visual indicator as alignment indicia on said display means that represents to the user the location of said first screen relative to said work piece holding means; and i) means for creating at least two display indicia on said display means, for indicating, by a first indicia, the position corresponding to the stored first signals associated with said first screen, said first indicia remaining on said display means after said first screen has been replaced by a subsequent screen adjacent said light sensing locating means, and a second indicia, corresponding to first signals currently being provided which correspond to the subsequent screen, so that the user, by observing the first and second indicia on said display means, and by operating said adjusting means, changes the spatial position of the subsequent screen so as to coincide the second and first indicia and to actuate said adjusting means to lock such subsequent screen in that changed spatial orientation to thereby accurately preposition the subsequent screen with the print area of the subsequent screen positioned to print on the print surface its print portion in the desired close alignment with relation to the print portion produced by the print area of said first screen.

* * * * *